US011554299B2

(12) United States Patent
Stokke

(10) Patent No.: US 11,554,299 B2
(45) **Date of Patent: *Jan. 17, 2023**

(54) GOLF CLUB HEADS WITH OPTIMIZED CHARACTERISTICS AND RELATED METHODS

(71) Applicant: KARSTEN MANUFACTURING CORPORATION, Phoenix, AZ (US)

(72) Inventor: Ryan M. Stokke, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/244,732

(22) Filed: Apr. 29, 2021

(65) Prior Publication Data

US 2021/0245018 A1 Aug. 12, 2021

Related U.S. Application Data

(63) Continuation of application No. 16/823,719, filed on Mar. 19, 2020, now Pat. No. 11,117,026, which is a (Continued)

(51) Int. Cl.
*A63B 53/04* (2015.01)
*A63B 53/08* (2015.01)

(Continued)

(52) U.S. Cl.
CPC ..... *A63B 53/0466* (2013.01); *A63B 53/02* (2013.01); *A63B 53/08* (2013.01);

(Continued)

(58) Field of Classification Search
CPC ..... A63B 53/0466; A63B 53/08; A63B 53/02; A63B 60/02; A63B 2053/0491;

(Continued)

(56) References Cited

U.S. PATENT DOCUMENTS 5,516,107 A 5/1996 Okumoto
5,935,020 A 8/1999 Stites et al.

(Continued)

FOREIGN PATENT DOCUMENTS

EP 2340875 7/2011
JP 2005046442 2/2005

(Continued)

OTHER PUBLICATIONS

International Search Report and Written Opinion for PCT/US2014/028134, dated Jul. 1, 2014.

(Continued)

*Primary Examiner* — Sebastiano Passaniti

(57) ABSTRACT

Embodiments of golf club heads comprising a head interior bounded by a head front portion, a head rear portion, a head heel portion, a head toe portion, a head top portion, and a head sole portion, the golf club heads further comprising various optimized characteristics including optimizing the head center of gravity height and depth in relation to the head volume and mass, are presented herein. Other examples and related methods are also disclosed herein.

20 Claims, 9 Drawing Sheets

Related U.S. Application Data continuation of application No. 15/655,638, filed on Jul. 20, 2017, now Pat. No. 10,610,745, which is a continuation-in-part of application No. 15/413,684, filed on Jan. 24, 2017, now Pat. No. 10,080,933, which is a continuation-in-part of application No. 14/836,729, filed on Aug. 26, 2015, now Pat. No. 9,675,851, which is a continuation of application No. 13/826,111, filed on Mar. 14, 2013, now Pat. No. 9,186,561.

(60) Provisional application No. 62/365,133, filed on Jul. 21, 2016, provisional application No. 62/404,602, filed on Oct. 5, 2016, provisional application No. 62/286,899, filed on Jan. 25, 2016.

(51) Int. Cl.
*A63B 53/02* (2015.01)
*A63B 60/02* (2015.01)
*A63B 71/06* (2006.01)

(52) U.S. Cl.
CPC ..... *A63B 60/02* (2015.10); *A63B 53/0408* (2020.08); *A63B 53/0412* (2020.08); *A63B 53/0433* (2020.08); *A63B 2053/0491* (2013.01); *A63B 2071/0694* (2013.01)

(58) Field of Classification Search
CPC ..... A63B 2071/0694; A63B 53/0408; A63B 53/0412; A63B 53/0433
USPC ..... 473/324–350, 287–292
See application file for complete search history.

(56) References Cited

U.S. PATENT DOCUMENTS

| | | | |
|---|---|---|---|
| 6,123,627 | A | 9/2000 | Antonious |
| 6,524,198 | B2 | 2/2003 | Takeda |
| 6,776,723 | B2 | 8/2004 | Bliss et al. |
| 6,939,247 | B1 | 9/2005 | Schweigert et al. |
| 6,991,558 | B2 | 2/2006 | Beach et al. |
| 7,137,905 | B2 | 11/2006 | Kohno |
| 7,163,468 | B2 | 1/2007 | Gibbs et al. |
| 7,318,780 | B2 | 1/2008 | Oyama |
| 7,413,520 | B1 | 8/2008 | Hocknell et al. |
| 7,448,964 | B2 | 11/2008 | Schweigert et al. |
| 7,500,926 | B2 | 3/2009 | Rae et al. |
| 7,575,524 | B2 | 8/2009 | Willett et al. |
| 7,731,603 | B2 | 6/2010 | Beach |
| 7,850,544 | B2 | 12/2010 | Meyer et al. |
| 8,025,591 | B2 | 9/2011 | De La Cruz et al. |
| 8,083,609 | B2 | 12/2011 | Burnett et al. |
| 8,100,781 | B2 | 1/2012 | Burnett et al. |
| 8,167,737 | B2 | 5/2012 | Oyama |
| 8,192,304 | B2 | 6/2012 | Rae et al. |
| 8,206,244 | B2 | 6/2012 | Honea et al. |
| 8,241,143 | B2 | 8/2012 | Albertsen et al. |
| 8,267,808 | B2 | 9/2012 | De La Cruz et al. |
| 8,333,668 | B2 | 12/2012 | De La Cruz et al. |
| 8,353,782 | B1 | 1/2013 | Beach et al. |
| 8,371,957 | B2 | 2/2013 | Schweigert et al. |
| 8,435,137 | B2 | 5/2013 | Hirano |
| 8,496,544 | B2 | 7/2013 | Curtis et al. |
| 8,506,419 | B2 | 8/2013 | Hirano |
| 8,608,589 | B2 | 12/2013 | Ferguson et al. |
| 8,647,216 | B2 | 2/2014 | Beach et al. |
| 8,663,029 | B2 | 3/2014 | Beach |
| 8,758,153 | B2 | 6/2014 | Sargent et al. |
| 8,790,196 | B2 | 7/2014 | Solheim et al. |
| 8,821,312 | B2 | 9/2014 | Burnett et al. |
| 8,900,069 | B2 | 12/2014 | Beach et al. |
| 9,144,722 | B2 | 9/2015 | Schweigert et al. |
| 9,168,429 | B2 | 10/2015 | Schweigert et al. |
| 9,186,561 | B2 | 11/2015 | Schweigert et al. |
| 9,358,430 | B2 | 6/2016 | Greaney et al. |
| 9,675,851 | B2 | 6/2017 | Schweigert et al. |
| 9,764,205 | B2 | 9/2017 | Schweigert et al. |
| 9,764,206 | B2 | 9/2017 | Schweigert et al. |
| 10,080,933 | B2 | 9/2018 | Stokke et al. |
| 10,207,161 | B2 | 2/2019 | Stokke |
| 10,238,938 | B2 | 3/2019 | Schweigert |
| 10,357,700 | B2 | 7/2019 | Schweigert |
| 10,434,381 | B2 | 10/2019 | Stokke |
| 10,486,037 | B2 | 11/2019 | Schweigert |
| 10,556,159 | B2 | 2/2020 | Stokke |
| 10,610,745 | B2 | 4/2020 | Stokke |
| 10,857,435 | B2 | 12/2020 | Schweigert |
| 11,117,026 | B2 * | 9/2021 | Stokke ..... A63B 53/02 |
| 2002/0006836 | A1 | 1/2002 | Helmstetter et al. |
| 2003/0032500 | A1 | 2/2003 | Nakahara et al. |
| 2005/0239576 | A1 | 10/2005 | Stites et al. |
| 2009/0029795 | A1 | 1/2009 | Schweigert et al. |
| 2009/0088269 | A1 | 4/2009 | Beach et al. |
| 2009/0137338 | A1 | 5/2009 | Kajita |
| 2009/0264218 | A1 | 10/2009 | Willett et al. |
| 2010/0048316 | A1 | 2/2010 | Honea et al. |
| 2010/0234125 | A1 | 9/2010 | Aoyama et al. |
| 2010/0234126 | A1 | 9/2010 | Crackett et al. |
| 2010/0285901 | A1 | 11/2010 | Schweigert |
| 2011/0250986 | A1 | 10/2011 | Schweigert |
| 2012/0071267 | A1 | 3/2012 | Burnett et al. |
| 2012/0071268 | A1 | 3/2012 | Albertsen et al. |
| 2012/0083361 | A1 | 4/2012 | Beach et al. |

FOREIGN PATENT DOCUMENTS

| | | |
|---|---|---|
| JP | 4010305 | 11/2007 |
| JP | 2008154999 | 2/2009 |
| JP | 2009061264 | 3/2009 |
| JP | 3172497 | 12/2011 |
| JP | 5244068 | 7/2013 |
| WO | 2014152899 | 9/2014 |

OTHER PUBLICATIONS

International Search Report and Written Opinion for PCT/US2017/043142, dated Sep. 27, 2017.

* cited by examiner

GOLF CLUB HEADS WITH OPTIMIZED CHARACTERISTICS AND RELATED METHODS

CROSS REFERENCE TO RELATED APPLICATIONS

This is a continuation of U.S. patent application Ser. No. 16/823,719, filed Mar. 19, 2020, which is a continuation of U.S. patent application Ser. No. 15/655,638, now U.S. Pat. No. 10,610,745, filed Jul. 20, 2017, which is a continuation in part of U.S. patent application Ser. No. 15/413,684, now U.S. Pat. No. 10,080,933, filed on Jan. 24, 2017, which is a continuation in part of U.S. patent application Ser. No. 14/836,729, now U.S. Pat. No. 9,675,851, filed on Aug. 26, 2015, which is a continuation of U.S. patent application Ser. No. 13/826,111, now U.S. Pat. No. 9,186,561, filed on Mar. 14, 2013. U.S. patent application Ser. No. 15/655,638 also claims the benefit of U.S. Provisional Patent Appl. No. 62/365,133, filed on Jul. 21, 2016, and U.S. Provisional Patent Appl. No. 62/404,602, filed on Oct. 5, 2016. U.S. patent application Ser. No. 15/413,684 also claims the benefit of U.S. Provisional Patent Appl. No. 62/286,899, filed on Jan. 25, 2016. The contents of all of the above-described disclosures are fully incorporated herein by reference.

TECHNICAL FIELD

The present disclosure relates generally to sports equipment, and relates, more particularly, to golf club heads with optimized characteristics and related methods.

BACKGROUND

Golf club heads often comprise different features that can be designed or configured to improve one or more of their performance characteristics. Innate interplay between such different features often exists, however, such that adjusting or configuring one feature may inherently alter another feature, often disadvantageously. As an example, expanding the strikeface of a golf club to provide a greater impact area can alter the location of the center of gravity of the golf club disadvantageously, and unintended performance consequences may ensue if features are not configured or designed in a balanced manner to account for the interplay between the different features.

Considering the above, further developments with respect to golf club features that are balanced with respect to each other will enhance the performance of golf clubs.

BRIEF DESCRIPTION OF THE DRAWINGS

The present disclosure may be better understood from a reading of the following detailed description of examples of embodiments, taken in conjunction with the accompanying figures.

Figure 1:
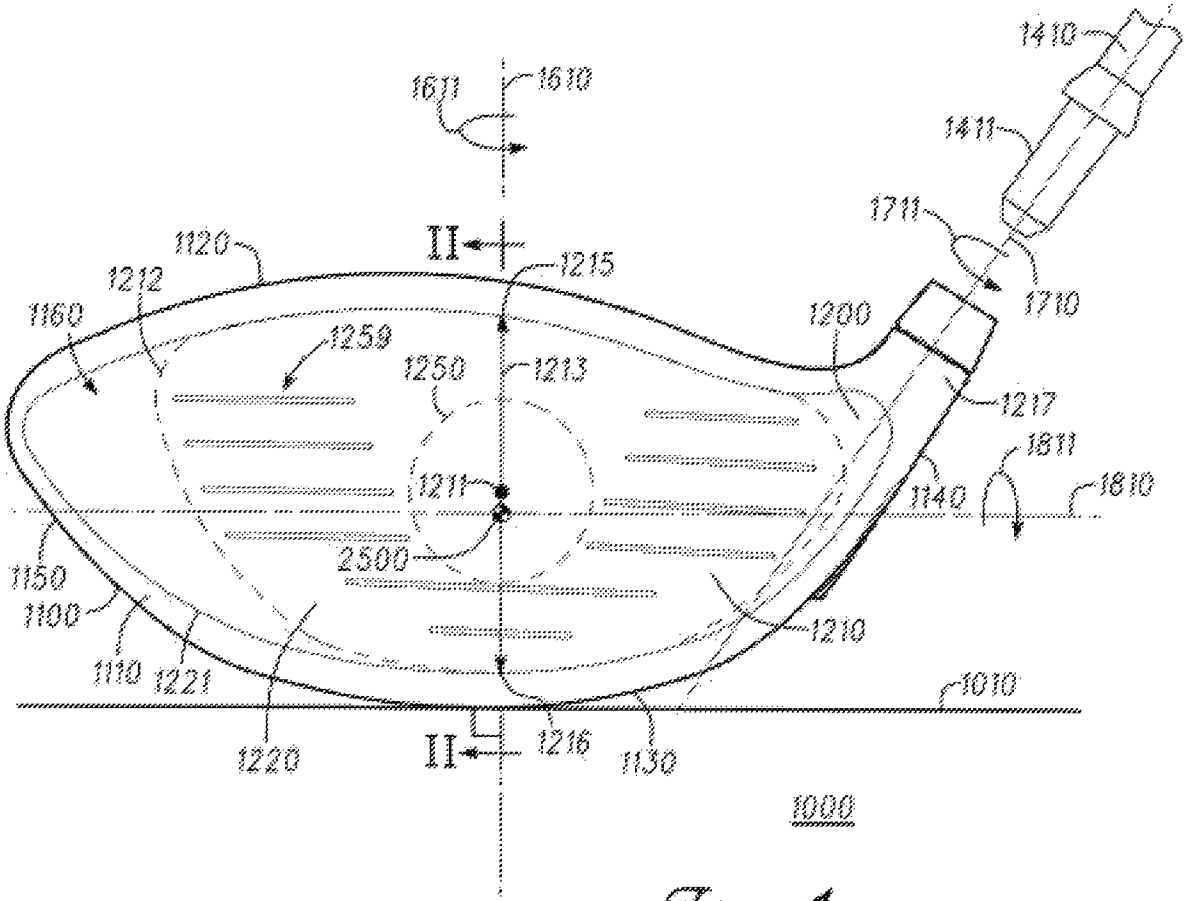
FIG. 1 illustrates a front view of a golf club head in accordance with the present disclosure.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

DESCRIPTION

In one example, a golf club head can comprise a head body comprising a head interior and a hosel structure. The head interior can be bounded by a head front portion, a head rear portion, a head heel portion, a head toe portion, a head top portion, and a head sole portion. The hosel structure can have a bore for receiving a golf club shaft, where the bore can have a hosel axis. The golf club head can also comprise a head center of gravity, a head horizontal axis extending through the head center of gravity, from the head heel portion to the head toe portion, and parallel to a ground plane when the golf club head is at an address position over the ground plane, a hosel moment of inertia about the hosel axis, and a horizontal moment of inertia about the head horizontal axis. The horizontal moment of inertia can be greater than or equal to 39% of the hosel moment of inertia.

In one example, a golf club head can comprise a head body comprising a head interior and a hosel structure. The head interior can be bounded by a head front portion, a head rear portion, a head heel portion, a head toe portion, a head top portion, and a head sole portion. The hosel structure can have a bore for receiving a golf club shaft, where the bore can have a hosel axis. The golf club head can also comprise a head center of gravity, a head vertical axis extending through the head center of gravity, from the head top portion to the head sole portion, and perpendicular to a ground plane when the golf club head is at address over the ground plane, a hosel moment of inertia about the hosel axis, and a vertical moment of inertia about the head vertical axis. The vertical moment of inertia can be greater than or equal to 59% of the hosel moment of inertia.

In one implementation, a method for providing a golf club head can comprise providing a head body having a head interior and a hosel structure. The head interior can be bounded by a head front portion, a head rear portion, a head heel portion, a head toe portion, a head top portion, and a head sole portion. The hosel structure can have a bore for receiving a golf club shaft, where the bore can have a hosel axis. The method can also comprise coupling the golf club shaft to the hosel structure. A head horizontal axis can extend through a head center of gravity of the golf club head, from the head heel portion to the head toe portion, and parallel to a ground plane when the golf club head is at an address position over the ground plane. A head vertical axis can extend through the head center of gravity, from the head top portion to the head sole portion, and perpendicular to the ground plane when the golf club head is at address over the ground plane. In addition, providing the head body can comprise at least one of: (a) establishing a horizontal moment of inertia about the head horizontal axis to be greater than or equal to 39% of a hosel moment of inertia about the hosel axis, or (b) establishing a vertical moment of inertia about the head vertical axis to be greater than or equal to 59% of the hosel moment of inertia about the hosel axis.

In one example, a golf club head can comprise a head body comprising a head front portion, a head rear portion, a head heel portion, a head toe portion, a head sole portion, a head top portion, and a hosel structure having a bore for receiving a golf club shaft, where the bore can have a hosel axis. The golf club head can also comprise a strikeface at the head front portion and comprising a strikeface centerpoint, a head volume measured in cc's and comprising a head volume magnitude greater than 420, a head center of gravity, and an optimization characteristic. When the golf club head is at an address position over a ground plane, a head vertical axis extends through the head center of gravity and is orthogonal to the ground plane, and a head horizontal axis extends through the head center of gravity, and is orthogonal to the head vertical axis. A loft plane of the golf club head can be tangent to the strikeface centerpoint. A front plane of the golf club head can extend through the strikeface centerpoint and parallel to the hosel axis. A head depth plane can extend through the strikeface centerpoint, parallel to the head horizontal axis and perpendicular to the loft plane. A CG height can axis extends through the head center of gravity and can intersect the head depth plane perpendicularly at a first intersection point. A head CG height of the head center of gravity can be measured, along the CG height axis, between the head center of gravity and the first intersection point. A head CG depth of the head center of gravity can be measured, parallel to the ground plane and orthogonal to the front plane, between (a) a second intersection point located at an intersection between the front plane and the ground plane, and (b) a third intersection point located at an intersection between the head vertical axis and the ground plane. The optimization characteristic can be defined by (a) the head volume magnitude added to (b) a ratio between the head CG depth divided by an absolute value of the head CG height. The optimization characteristic can be greater than or equal to 425.

In one example, a golf club head can comprise a head body comprising a head front portion, a head rear portion, a head heel portion, a head toe portion, a head sole portion, a head top portion, and a hosel structure having a bore for receiving a golf club shaft, where the bore can have a hosel axis. The golf club head can also comprise a strikeface at the head front portion and comprising a strikeface centerpoint, and a head center of gravity. When the golf club head is at an address position over a ground plane, a head vertical axis extends through the head center of gravity and is orthogonal to the ground plane, and a head horizontal axis extends through the head center of gravity, and is orthogonal to the head vertical axis. A loft plane of the golf club head can be tangent to the strikeface centerpoint. A front plane of the golf club head can extend through the strikeface centerpoint and parallel to the hosel axis. A top plane of the golf club head can extend through the strikeface centerpoint and parallel to the ground plane. A head depth plane can extend through the strikeface centerpoint, parallel to the head horizontal axis and perpendicular to the loft plane. A CG height axis can extend through the head center of gravity and can intersect the head depth plane perpendicularly at a first intersection point. A head CG height of the head center of gravity can be measured, along the CG height axis, between the head center of gravity and the first intersection point. A head CG depth of the head center of gravity can be measured, parallel to the ground plane and orthogonal to the front plane, between (a) a second intersection point located at an intersection between the front plane and the ground plane, and (b) a third intersection point located at an intersection between the head vertical axis and the ground plane. A head CG upper bound can be measured, along the head vertical axis, between the head center of gravity and a fourth intersection point located at an intersection between the head vertical axis and the top plane. An absolute value of the head CG height can be less than or equal to 2.54 mm. The head CG depth can be greater than or equal to 40.64 mm. In other embodiments, the head CG depth can be greater than approximately 41 mm, and less than approximately 102 mm. In further embodiments, the head CG depth can be greater than approximately 42 mm, 43 mm, 44 mm, 45 mm, 46 mm, 47 mm, 48 mm, 49 mm, 50 mm, 55 mm, 60 mm, 65 mm, or 70 mm. The head CG upper bound can be approximately 0 mm to approximately −30 mm. In other embodiments, the head CG upper bound can be less than approximately −8 mm, −9 mm, −10 mm, −11 mm, −12 mm, −13 mm, −14 mm, −15 mm, −20 mm, or −25 mm.

In one implementation, a method for providing a golf club head can comprise providing a head body comprising a head front portion, a head rear portion, a head heel portion, a head toe portion, a head sole portion, a head top portion, and a hosel structure having a bore for receiving a golf club shaft, the bore having a hosel axis. The method can also comprise coupling a strikeface at the head front portion, and establishing an optimization characteristic of the golf club head. The strikeface comprises a strikeface centerpoint. A head volume of the golf club head can be measured in cc's and can comprise a head volume magnitude greater than 420. When the golf club head is at an address position over a ground plane, a head vertical axis can extend through the head center of gravity and can be orthogonal to the ground plane. A head horizontal axis can extend through the head center of gravity, and can be orthogonal to the head vertical axis. A loft plane of the golf club head can be tangent to the strikeface centerpoint. A front plane of the golf club head can extend through the strikeface centerpoint and parallel to the hosel axis. A head depth plane can extend through the strikeface centerpoint, parallel to the head horizontal axis and perpendicular to the loft plane. A CG height axis can extend through the head center of gravity and can intersect the head depth plane perpendicularly at a first intersection point. A head CG height of the head center of gravity can be measured, along the CG height axis, between the head center of gravity and the first intersection point. A head CG depth of the head center of gravity can be measured, parallel to the ground plane and orthogonal to the front plane, between (a) a second intersection point located at an intersection between the front plane and the ground plane, and (b) a third intersection point located at an intersection between the head vertical axis and the ground plane. The optimization characteristic can be established by (a) the head volume magnitude added to (b) a ratio between the head CG depth divided by an absolute value of the head CG height, where the optimization characteristic can be greater than or equal to 425.

In one example, a golf club head can comprise a head body, a face portion, and a head center of gravity, and at least one of a first performance characteristic or a second performance characteristic. The head body can comprise a head front portion, a head rear portion, a head heel portion, a head toe portion, a head sole portion, a head top portion, and a hosel structure having a bore for receiving a golf club shaft, where the bore can have a hosel axis. The face portion can be at the head front portion and can comprise a strikeface centerpoint, a strikeface perimeter, and a face height bounded by the strikeface perimeter. When the golf club head is at an address position over a ground plane, a head vertical axis extends through the head center of gravity and is orthogonal to the ground plane, and a head horizontal axis extends through the head center of gravity, and is orthogonal to the head vertical axis. A loft plane of the golf club head can be tangent to the strikeface centerpoint. A front plane of the golf club head can extend through the strikeface centerpoint and parallel to the hosel axis. A head depth plane can extend through the strikeface centerpoint, parallel to the head horizontal axis and perpendicular to the loft plane. A CG height axis can extend through the head center of gravity and can intersect the head depth plane perpendicularly at a first intersection point. A head CG height of the head center of gravity can be measured, along the CG height axis, between the head center of gravity and the first intersection point. A head CG depth of the head center of gravity can be measured, parallel to the ground plane and orthogonal to the front plane, between (a) a second intersection point located at an intersection between the front plane and the ground plane, and (b) a third intersection point located at an intersection between the head vertical axis and the ground plane. The face height can be approximately 33 mm to approximately 71 mm, measured parallel to the loft plane. The first performance characteristic can comprise the head CG height being less than or equal to approximately 5.08 mm. The second performance characteristic can comprise a CG performance ratio of less than or equal to 0.56, as defined by (a) 76.2 mm minus the face height, divided by (b) the head CG depth.

In one example, a golf club head can comprise a head body, a face portion, and a head center of gravity. The head body can comprise a head front portion, a head rear portion, a head heel portion, a head toe portion, a head sole portion, a head top portion, and a hosel structure having a bore for receiving a golf club shaft, the bore having a hosel axis. The hosel structure can comprise a hosel diameter. The face portion can be coupled to the head front portion and can comprise a strikeface having a strikeface centerpoint, a strikeface perimeter, and a face height. When the golf club head is at an address position over a ground plane, a head vertical axis extends through the head center of gravity and is orthogonal to the ground plane, and a head horizontal axis extends through the head center of gravity, and is orthogonal to the head vertical axis. A loft plane of the golf club head can be tangent to the strikeface centerpoint. A front plane of the golf club head can extend through the strikeface centerpoint and parallel to the hosel axis. A top plane of the golf club head can extend through the strikeface centerpoint and parallel to the ground plane. A head depth plane can extend through the strikeface centerpoint, parallel to the head horizontal axis and perpendicular to the loft plane. A CG height axis can extend through the head center of gravity and can intersect the head depth plane perpendicularly at a first intersection point. A head CG height of the head center of gravity can be measured, along the CG height axis, between the head center of gravity and the first intersection point. A head CG depth of the head center of gravity can be measured, parallel to the ground plane and orthogonal to the front plane, between (a) a second intersection point located at an intersection between the front plane and the ground plane, and (b) a third intersection point located at an intersection between the head vertical axis and the ground plane. A head CG upper bound can be measured, along the head vertical axis, between the head center of gravity and a fourth intersection point located at an intersection between the head vertical axis and the top plane. The face height can be approximately 33 mm to approximately 71 mm, as delimited by the strikeface perimeter and measured parallel to the loft plane. A CG performance ratio between (a) 76.2 mm minus the face height, and (b) the head CG depth, is less than or equal to 0.56. The head body can comprise a driver-type body. A head volume of the golf club head can be approximately 420 cc to approximately 470 cc. A head weight of the golf club head can be approximately 185 grams to approximately 225 grams. The head CG height can be approximately 0 mm to approximately 3.18 mm. The head CG depth can be approximately 25 mm to approximately 102 mm. In other embodiments, the head CG depth can be greater than approximately 41 mm, and less than approximately 102 mm. In further embodiments, the head CG depth can be greater than approximately 42 mm, 43 mm, 44 mm, 45 mm, 46 mm, 47 mm, 48 mm, 49 mm, 50 mm, 55 mm, 60 mm, 65 mm, or 70 mm. The head CG upper bound can be approximately 0 mm to approximately −30 mm. In other embodiments, the head CG upper bound can be less than approximately −8 mm, −9 mm, −10 mm, −11 mm, −12 mm, −13 mm, −14 mm, −15 mm, −20 mm, or −25 mm. The head body can comprise a weight structure located towards the sole portion and the rear portion of the head body.

In one implementation, a method for providing a golf club head can comprise providing a head body having a head front portion, a head rear portion, a head heel portion, a head toe portion, a head sole portion, a head top portion, and a hosel structure having a bore for receiving a golf club shaft, the bore having a hosel axis. The method can also comprise coupling a face portion to the head front portion, the face portion comprising a strikeface having a strikeface centerpoint, a strikeface perimeter, and a face height bounded by the strikeface perimeter. The method an further comprise establishing at least one of: a first performance characteristic of the golf club head, or a second performance characteristic of the golf club head. When the golf club head is at an address position over a ground plane, a head vertical axis extends through a head center of gravity of the golf club head and is orthogonal to the ground plane, and a head horizontal axis extends through the head center of gravity, and is orthogonal to the head vertical axis. A loft plane of the golf club head can be tangent to the strikeface centerpoint. A front plane of the golf club head can extend through the strikeface centerpoint and parallel to the hosel axis. A head depth plane can extend through the strikeface centerpoint, parallel to the head horizontal axis and perpendicular to the loft plane. A CG height axis can extend through the head center of gravity and can intersect the head depth plane perpendicularly at a first intersection point. A head CG height of the golf club head can be measured, along the CG height axis, between the head center of gravity and the first intersection point. A head CG depth of the head center of gravity can be measured, parallel to the ground plane and orthogonal to the front plane, between: (a) a second intersection point located at an intersection between the front plane and the ground plane, and (b) a third intersection point located at an intersection between the head vertical axis and the ground plane. The face height can be approximately 33 mm to approximately 71 mm, measured parallel to the loft plane. The first performance characteristic can comprise the head CG height being less than or equal to approximately 5.08 mm. The second performance characteristic can comprise a CG performance ratio of less than or equal to 0.56, as defined by (a) 76.2 mm minus the face height, divided by (b) the head CG depth.

Other examples and embodiments are further disclosed herein. Such examples and embodiments may be found in the figures, in the claims, and/or in the present description.

Figure 2:
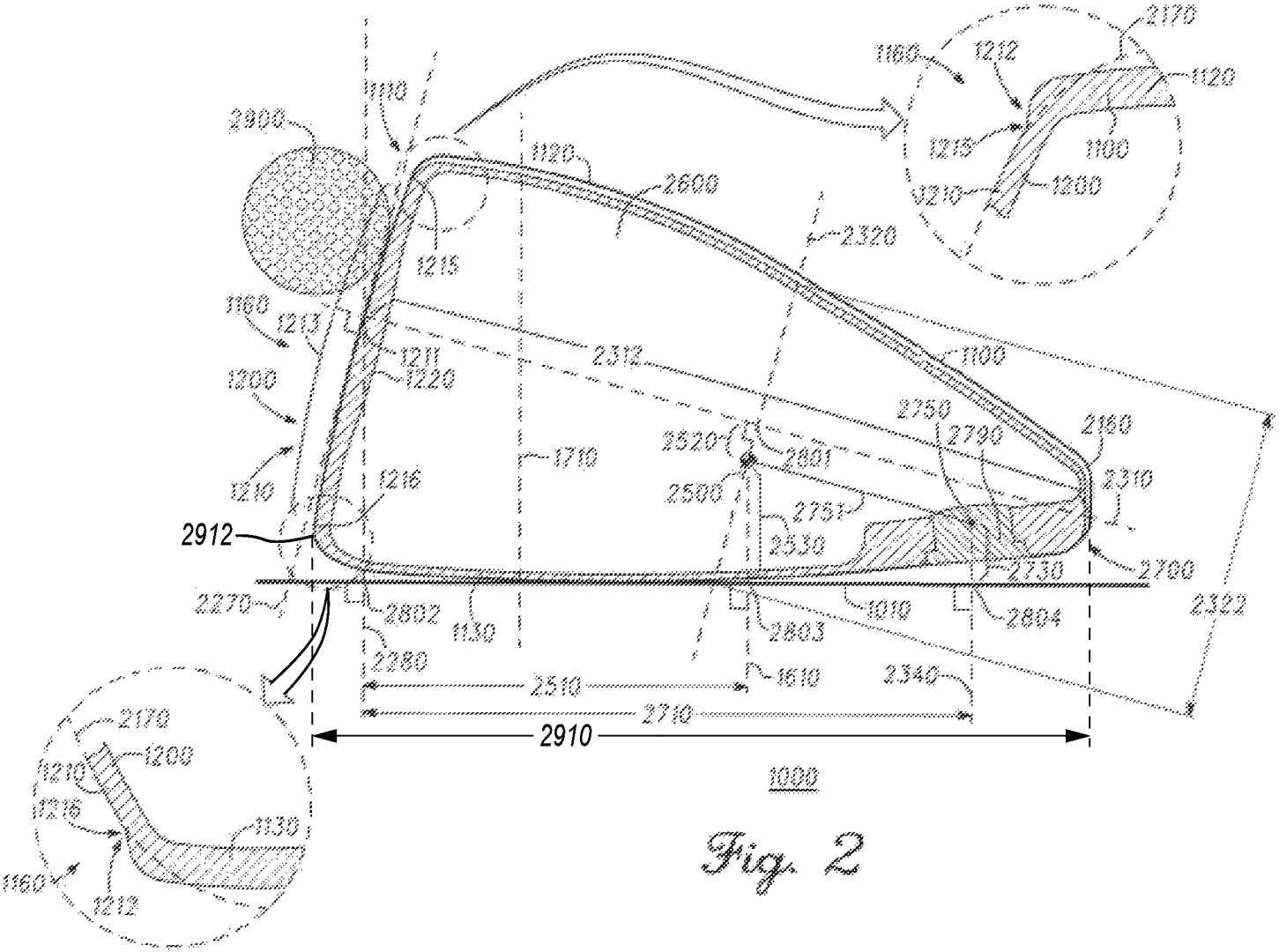
FIG. 2 illustrates a side cross-sectional view of the golf club head along line II-II of FIG. 1.
Figure 3:
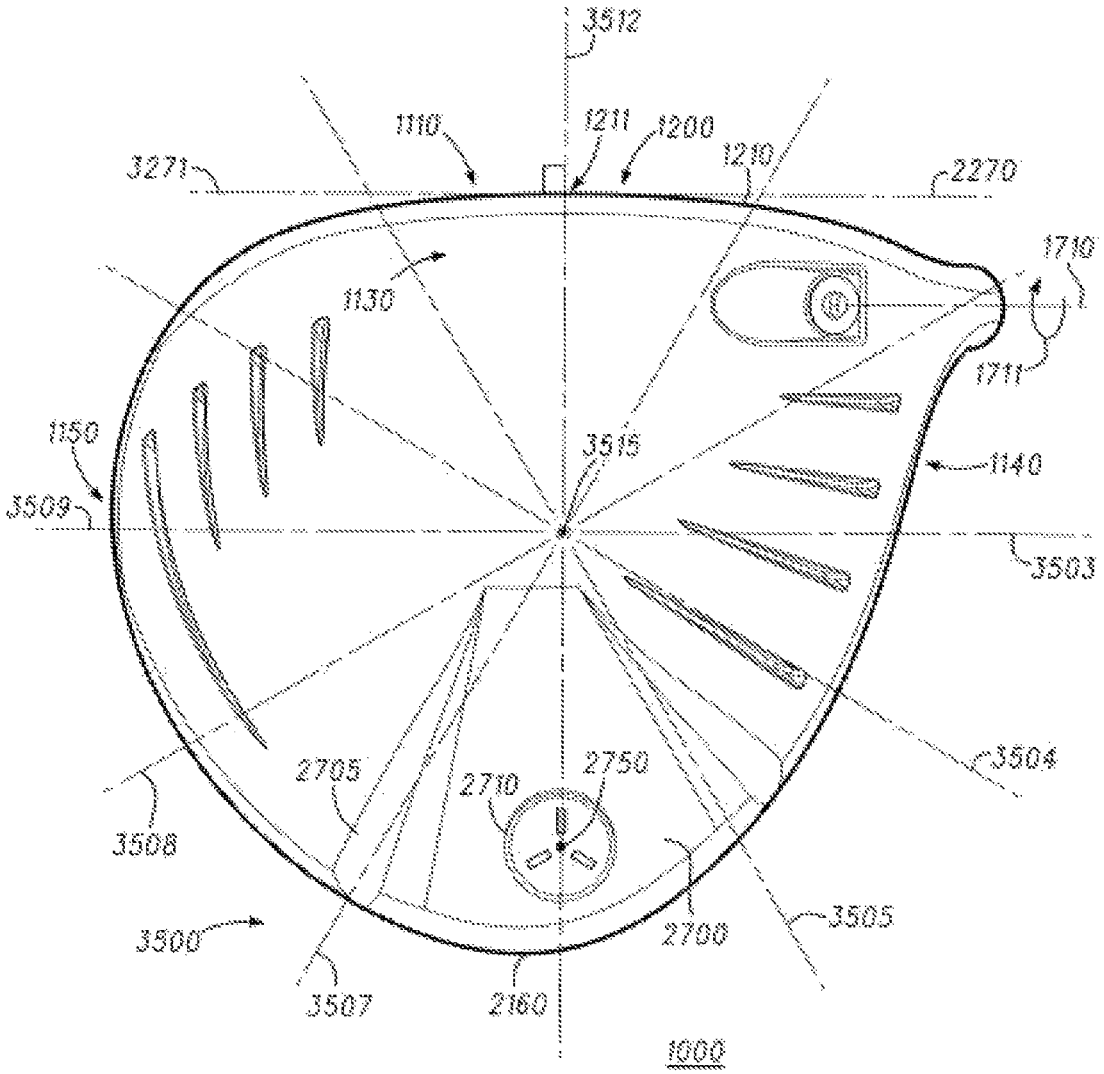
FIG. 3 illustrates a bottom view of the golf club head of FIGS. 1-2.

Turning to the drawings, FIG. 1 illustrates a front view of golf club head 1000, comprising head body 1100 and face portion 1200. Face portion 1200 includes strikeface 1210. FIG. 2 illustrates a side cross-sectional view of golf club head 1000 along line II-II of FIG. 1. FIG. 3 illustrates a bottom view of golf club head 1000. FIGS. 1-3 present golf club head 1000 at an address position relative to ground plane 1010, where hosel axis 1710 is at a 60-degree angle with ground plane 1010 with respect to a front view of golf club head 1000 (FIG. 1), and where hosel axis 1710 is substantially orthogonal to ground plane 1010 with respect to a side view of golf club head 1000 (FIG. 2).

In the present embodiment, head body 1100 and face portion 1200 comprise separate pieces of material coupled together, for example, via a welding process. In other examples, however, face portion 1200 may comprise a single piece of material with one or more portions of head body 1100, such as head front portion 1110, head top portion 1120, head sole portion 1130, head heel portion 1140, head toe portion 1150, and/or head rear portion 2160. Head forward surface 1160 of golf club head 1000 comprises strikeface 1210, face portion 1200, and at least part of head front portion 1110. In some embodiments, head forward surface 1160 also can include at least part of head sole portion 1130. In the same or different embodiments, head front portion 1110 can include strikeface 1210 and/or face portion 1200.

Face portion 1200 comprises strikeface 1210 having strikeface centerpoint 1211, strikeface perimeter 1212, and face height 1213. Strikeface centerpoint 1211 is located at a geometric centerpoint of strikeface perimeter 1212 in the present example, and at a midpoint of face height 1213. In the same or other examples, strikeface centerpoint 1211 also can be centered with respect to engineered impact zone 1250, which can be defined by a region of grooves 1259 of strikeface 1210. As another approach, strikeface centerpoint 1211 can be located in accordance with the definition of a golf governing body such as the United States Golf Association (USGA). For example, strikeface centerpoint 1211 can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

Golf club head 1000 comprises loft plane 2270 (FIG. 2), which is at least tangent to strikeface centerpoint 1211 at strikeface 1210. Face height 1213 can be measured parallel to loft plane 2270 between strikeface top end 1215 and strikeface bottom end 1216 of strikeface perimeter 1212, and can be of approximately 33 millimeters (mm) to approximately 71 mm in the present or other examples.

Strikeface perimeter 1212, comprising strikeface top end 1215 and strikeface bottom end 1216 defining face height 1213, need not bound an entirety of face portion 1200. For example, as seen in FIG. 1, strikeface 1210 is bounded by strikeface perimeter 1212 and is only part of face portion 1200. In some examples, strikeface 1210 can comprise a roll radius and/or a bulge radius, and strikeface perimeter 1212 can be defined along a transition boundary where a contour of face portion 1200 departs from the roll radius and/or the bulge radius of strikeface 1210. For example, FIG. 2 contains a zoom view of part of the top transition boundary of golf club head 1000, highlighting vertical roll radius 2170 extending along strikeface 1210, and showing how strikeface top end 1215 is located at the top transition boundary where head forward surface 1160 departs from vertical roll radius 2170. FIG. 2 also contains a zoom view of part of the bottom transition boundary of golf club head 1000, highlighting vertical roll radius 2170 extending vertically along strikeface 1210, and showing how strikeface bottom end 1216 is located at the bottom transition boundary where head forward surface 1160 departs from vertical roll radius 2170.

In the same or other embodiments, strikeface perimeter 1212 can be defined with respect to the edge of a strikeplate comprising the strikeface. For instance, face portion 1200 comprises strikeplate 1220, where strikeface 1210 forms an exterior surface of faceplate 1220, and where strikeplate 1220 is joined to head front portion 1110 along strikeplate edge 1221. In the present example, strikeplate edge 1221 defines at least part of strikeface perimeter 1212, including the top and bottom sections of strikeface perimeter 1212 where strikeface top end 1215 and strikeface bottom end 1216 are respectively located to define face height 1213, but there can be other examples where the strikeplate edge of the strikeplate can define a majority or all of the strikeface perimeter of the strikeface.

As shown in FIG. 2, golf club head 1000 also comprises head center of gravity (CG) 2500, head depth plane 2310, and CG height axis 2320, where head depth plane 2310 extends through strikeface centerpoint 1211 and is perpendicular to loft plane 2270, and where CG height axis 2320 extends through head center of gravity 2500 and intersects head depth plane 2310 perpendicularly at intersection point 2801. Golf club head 1000 also comprises a top plane 2330 which extends through strikeface centerpoint 1211, parallel to ground plane 1010.

Head center of gravity 2500 comprises CG height 2520 and CG depth 2510, which locate head center of gravity 2500 relative to golf club head 1000. In the present example, CG height 2520 can be measured along CG height axis 2320, between head center of gravity 2500 and intersection point 2801. CG depth 2510 can be measured, as seen in FIG. 2, parallel to ground plane 1010 and between intersection points 2802-2803. In the present example, intersection point 2802 is defined by the intersection between ground plane 1010 and front plane 2280, where front plane 2280 extends through strikeface centerpoint 1211, is parallel to hosel axis 1710, and is orthogonal to ground plane 1010 when golf club head 1000 is at the address position. In addition, intersection point 2803 is defined by the intersection between ground plane 1010 and head vertical axis 1610, where head vertical axis 1610 extends through head center of gravity 2500, and is orthogonal to ground plane 1010 when golf club head 1000 is at the address position. Head center of gravity 2500 can also be located relative to ground plane 1010, where head CG elevation 2530 of head center of gravity 2500 can be measured along head vertical axis 1610, between weight center 2750 and ground plane 1010. Head center of gravity 2500 can also be located relative to a head CG upper bound 2540, which can be measured along head vertical axis 1610, between head center of gravity 2500 and a fourth intersection point 2805 located at an intersection between head vertical axis 1610 and the top plane 2330. Head CG upper bound 2540 may be positive when measured above the top plane 2330, and may be negative when measured below the top plane 2330.

Head body 1100 of golf club head 1000 also comprises hosel structure 1217 (FIG. 1) and hosel axis 1710 extending along a center of a bore of hosel structure 1217. In the present example, a hosel coupling mechanism of golf club head 1000 comprises hosel structure 1217 and shaft sleeve 1411, where shaft sleeve 1411 can be coupled to an end of golf shaft 1410. Shaft sleeve 1411 can couple with hosel structure 1217 in a plurality of configurations, thereby permitting golf shaft 1410 to be secured to hosel structure 1217 at a plurality of angles relative to hosel axis 1710. There can be other examples, however, where shaft 1410 can be non-adjustably secured to hosel structure 1217.

Golf club heads in accordance with the present disclosure can be configured to exhibit one or more optimization characteristics that optimize or balance the performance thereof. For example, one characteristic of golf club heads that the present designs strive to optimize is that of face height and/or face size. Maximizing the face height and/or face size of a golf club head can have several benefits, such as increasing the target impact area of the strikeface to yield a more forgiving club head that produces better results for golf shots that are hit off-center of the strikeface centerpoint. In addition, a strikeface of larger height and/or size can provide for better energy transfer to the golf ball upon impact therewith, and may thus increase a characteristic time or a "spring effect" of the golf club head to achieve golf shots of longer distance. In some examples, the height or size of the strikeface may be augmented to achieve a characteristic time limit set by a golf governing body, such as the characteristic time limit of 239 microseconds (μs) set by the USGA in its Flexibility Procedure.

Indiscriminately increasing face height and/or size, however, can adversely affect performance in other areas, such as with respect to launch angle, ball spin, and/or ball speed of the golf ball upon impact with the strikeface. For example, increasing face height and/or size can decrease the CG depth between the center of gravity and the strikeface centerpoint of the golf club head to bring the center of gravity forward, thereby reducing the dynamic loft of the golf club head and thus decreasing the launch angle for the golf ball. As another example, increasing face height and/or size can raise the CG height between the center of gravity and the head depth plane to elevate the center of gravity away from the sole of the golf club head, thereby inhibiting a gear effect between the strikeface and the golf ball, thus preventing the golf club head from decreasing the amount of backspin of the golf ball created upon impact, and thus decreasing the distance the ball will travel due to the backspin.

Considering the above, the height or size of the face of the golf club head should be balanced with respect to the location of the center of gravity. With respect to golf club head 1000, strikeface 1210 has been increased to comprise an augmented face size and/or face height 1213 to provide a larger impact area and greater energy transfer to golf ball 2900. In particular, golf club head 1000 can be configured so that face height 1213 can be of approximately 33 mm to approximately 71 mm to provide greater impact area and energy transfer upon impact with golf ball 2900. In some examples, an area of strikeface 1210, including the augmented face area, can be of approximately 23.6 centimeters squared ($cm^2$) to approximately 45.2 $cm^2$.

Notwithstanding the augmented face size and/or face height 1213 described above, golf club head 1000 still restricts CG height 2520 from increasing towards head top portion 1120 and/or from straying too far from head depth plane 2310. For example, golf club head 1000 comprises a first optimization characteristic satisfying Relation 1 below:

$$|CG\ \text{height}_{2520}| \leq 5.08\ \text{mm} \qquad \text{[Relation 1]}$$

There can be examples where CG height 2520 can be of approximately 0 mm up to Relation 1's limit of 5.08 mm. CG height 2520 can also be of up to a maximum of approximately 4.45 mm, 3.81 mm, or 3.18 mm in other examples. In some implementations, the first optimization characteristic can decrease the backspin of golf ball 2900 via a gear effect between strikeface 1210 and golf ball 2900 for better performance. Although head center of gravity 2500 is shown in FIG. 2 as being below depth plane 2310, such that CG height 2520 extends between depth plane 2310 and head sole portion 1130, there can be embodiments where head center of gravity 2500 can be above depth plane 2310, such that CG height 2520 extends between depth plane 2310 and head top portion 1120, while still satisfying Relation 1 above. In some implementations, the head CG upper bound 2540 can be approximately 0 mm to approximately −30 mm. In other embodiments, the head CG upper bound 2540 can be less than approximately −8 mm, −9 mm, −10 mm, −11 mm, −12 mm, −13 mm, −14 mm, −15 mm, −20 mm, or −25 mm.

In addition, and considering the augmented face size and/or face height 1213 described above, golf club head 1000 still restricts center of gravity 2500 from moving towards strikeface 1212, thereby preventing CG depth 2510 from unduly decreasing. For example, golf club head 1000 comprises a second optimization characteristic satisfying Relation 2 below:

$$\frac{76.2\text{ mm} - \text{face } height_{1213}}{CG\ depth_{2510}} \leq 0.56 \quad \text{[Relation 2]}$$

Accordingly, the relationship between face height 1213 and CG depth 2510 is balanced pursuant to Relation 2 to maintain the second optimization characteristic of less than or equal to 0.56, thereby limiting the amount that CG depth 2510 can decrease towards strikeface 1210. There can be examples where CG depth 2510 can be approximately 25 mm to approximately 102 mm. In the same or other examples, CG depth 2510 can be at least approximately 39 mm. In the same or other examples, CG depth 2510 can be greater than approximately 41 mm, and less than approximately 102 mm. In further examples, CG depth 2510 can be greater than approximately 42 mm, 43 mm, 44 mm, 45 mm, 46 mm, 47 mm, 48 mm, 49 mm, 50 mm, 55 mm, 60 mm, 65 mm, or 70 mm. In some implementations, the second optimization characteristic can increase or optimize at least one of a dynamic loft of golf club head 1000 or a launch angle of golf ball 2900 upon impact therebetween.

In some examples, golf club head 1000 may be configured to comprise only one of the first or second optimization characteristics described above. For example, golf club head 1000 may comprise the first optimization characteristic and not the second optimization characteristic, thus satisfying Relation 1 without having to satisfy Relation 2. As another example, golf club head 1000 may comprise the second optimization characteristic and not the first optimization characteristic, thus satisfying Relation 2 without having to satisfy Relation 1. In addition, there can be embodiments where golf club head 1000 satisfies both Relations 1 and 2, and thus comprises the first and second optimization characteristics.

Golf club head 1000 can also comprise a third optimization characteristic with respect to head volume (HV) 2600 thereof. In the present example, head body 1000 of golf club head 1000 comprises a driver-type body with a head volume greater than or equal to 420 cubic centimeters (cc), and thus has a head volume magnitude greater than or equal to 420. For example, head body 1000 can comprise a head volume of 420 cc, thus having a head volume magnitude of 420. As another example, golf club head 1000 can comprise a head volume of 460 cc, thus having a head volume magnitude of 460. Golf club head 1000 can comprise a head volume up to approximately 470 cc, in some implementations, and/or a total head weight of approximately 185 grams to approximately 225 grams. In some specific examples, the total head weight can be approximately 202 grams, and/or the head volume can be of approximately 460 cc.

The third optimization characteristic can control the relationship between head volume 2600 and the location of center of gravity 2500, and can be defined to satisfy Relation 3 below:

$$HV + \frac{CG\ depth_{2510}}{|CG\ height_{2520}|} \geq 425 \quad \text{[Relation 3]}$$

In some instances, head volume 2600 can be increased to adjust, for instance, a moment of inertia (MOI) of golf club head 1000. An unrestrained increase in head volume, however, can have detrimental effects with respect to other characteristics of the golf club head. For example, increasing head volume 2600 can cause head center of gravity 2500 to shift towards head front portion 1110, towards head top portion 1120, towards other undesired directions, and/or away from a desired center of gravity location or direction(s), thereby hampering the performance of golf club head 1000. Such undesired changes in the center of gravity location can detrimentally affect one or more characteristics of the golf club head, such as launch speed, launch angle, gear effect, backspin, and or shot distance. Accordingly, the third optimization characteristic used to balance the relationship between head volume 2600 and the location of head center of gravity 2500 can be established to yield desirable and balanced attributes for golf club head 1000. For instance, a weight distribution of golf club head 1000 can be configured to satisfy Relation 3 so that golf club head 1000 can exhibit the third optimization characteristic, thereby permitting head volume 2600 to be augmented for greater moment of inertia and greater energy transfer to golf ball 2900 upon a golf impact between strikeface 1210 and golf ball 2900. In the same or other implementations, the weight distribution of golf club head 1000 can be configured for restricting CG depth 2510 from decreasing towards head front portion 1110 due to the augmented head volume 2600, thus increasing at least one of a dynamic loft of strikeface 1210 or a launch angle of golf ball 2900 upon the golf impact. In addition, the weight distribution of golf club head 1000 can be configured for restricting CG height 2520 from increasing towards head top portion 1120 as a result of the augmented head volume 2600, thereby decreasing a backspin of golf ball 2900 via a gear effect between strikeface 1210 and golf ball 2900 upon the golf impact.

Considering the above, to attain the third optimization characteristic in compliance with Relation 3, CG depth 2510 can be configured to be greater than or equal to 40.64 mm. In other embodiments, CG depth 2510 can be greater than approximately 41 mm, and less than approximately 102 mm. In further embodiments, CG depth 2510 can be greater than approximately 42 mm, 43 mm, 44 mm, 45 mm, 46 mm, 47 mm, 48 mm, 49 mm, 50 mm, 55 mm, 60 mm, 65 mm, or 70 mm. In the same or other embodiments, the absolute value of CG height 2520 can be less than or equal to 2.54 mm. Note that CG height 2520 is characterized as an absolute value, considering that head center of gravity 2500 can be above or below head depth plane 2310 in some embodiments. The head CG upper bound 2540 can be approximately 0 mm to approximately −30 mm. In other embodiments, the head CG upper bound 2540 can be less than approximately −8 mm, −9 mm, −10 mm, −11 mm, −12 mm, −13 mm, −14 mm, −15 mm, −20 mm, or −25 mm. Although the third optimization characteristic has a lower bound of at least 425, there can be other embodiments where the third optimization characteristic can be defined with respect to other lower bounds. For instance, the third optimization characteristic can comprise a lower bound of at least 435 or 445 in some implementations. In other examples, the third optimization characteristics can comprise a lower bound of at least 460, at least 470, at least 480, at least 490, or at least 500. The location of head center of gravity 2500 can also be designed or configured with respect to other features of golf club head 1000 in order to satisfy Relation 3 and/or to attain the third optimization characteristic. For instance, the location of head center of gravity 2500 can be configured such that CG depth 2510 comprises between approximately 25% to approximately 80% of head depth length 2312, where head depth length 2312 is measured from strikeface center-point 1211 to an intersection of an exterior of head rear portion 2160 by head depth plane 2310. As another example, the location of head center of gravity 2500 can be configured such that CG height 2520 comprises between approximately 0% to approximately 13% of CG height axis length 2322, where CG height axis length 2322 is measured from an intersection of an exterior of head top portion 1120 by CG height axis 2320, to an intersection of an exterior of head sole portion 1130 by CG height axis 2320.

The above described head CG depth 2510 and head CG height 2520 relate to driver type club heads. In embodiments where the club head is a fairway wood type club head, the head CG depth 2510 can be configured to be greater than or equal to 35 mm. In other embodiments of a fairway wood type club head, the CG depth 2510 can be greater than approximately 35 mm, and less than approximately 90 mm. In further embodiments of a fairway wood type club head, the CG depth 2510 can be greater than approximately 34.5 mm, 35 mm, 36 mm, 37 mm, 38 mm, 39 mm, 40 mm, 41 mm, 42 mm, 43 mm, 44 mm, 45 mm, or 46 mm. Further, in embodiments where the club head is a fairway wood type club head, the head CG height 2520, or the absolute value thereof, can be configured to be less than or equal to 12.8 mm. In other embodiments of a fairway wood type club head, the CG height 2520, or the absolute value thereof, can be less than approximately 13.0 mm, 12.8 mm, 12.6 mm, 12.4 mm, 12.2 mm, 12.0 mm, 11.8 mm, 11.6 mm, 11.4 mm, 11.2 mm, or 11.0 mm. In these embodiments, the volume of the fairway wood type club head can be between 300 cc and 400 cc, and the mass of the fairway wood type club head can be between 190 grams and 240 grams.

Golf club head 1000 can also comprise a hosel diameter of hosel structure 1217. The hosel diameter can be maintained to a minimum and/or relatively unchanged from a hosel diameter of a corresponding regular golf club head. In some examples, the hosel diameter can be less than approximately 0.78 inch (20 mm). For example, the hosel diameter can be less than approximately 0.78 inch and greater than approximately 0.50 inch. A hosel diameter within this range can impart performance benefits to a golf club head 1000. When the hosel diameter is within this range, the hosel can possess greater structural integrity, and the stresses experienced in the hosel during a golf club swing can be reduced. In addition to having a hosel diameter within this range, golf club head 1000 can further comprise the optimization characteristics relating to the center of gravity (CG) and moment of inertia (MOI) as described herein.

In further examples, the hosel diameter can be less than approximately 0.50 inch, 0.49 inch, 0.48 inch, 0.47 inch, 0.46 inch, 0.45 inch, 0.44 inch, 0.43 inch, 0.42 inch, 0.41 inch, or 0.40 inch. A hosel diameter less than 0.50 inch can impart additional performance benefits to golf club head 1000. When the hosel diameter is minimized as described above, the aerodynamic characteristics of golf club head 1000 can be improved as a result of the reduced aerodynamic drag from hosel structure 1217. In addition to having a hosel diameter within this range, golf club head 1000 can further comprise the optimization characteristics relating to the center of gravity (CG) and moment of inertia (MOI) as described herein.

Golf club head 1000 also can comprise a fourth optimization characteristic with respect to a balance between hosel MOI 1711 (FIG. 1) and horizontal MOI 1811 (FIG. 1). Hosel MOI 1711 is defined about hosel axis 1710. Horizontal MOI 1811 is defined about head horizontal axis 1810, which extends through head center of gravity 2500, from head heel portion 1140 to head toe portion 1150, and parallel to ground plane 1010 when golf club head 1000 is at the address position over ground plane 1010.

In some examples, horizontal MOI 1811 can be increased to restrict a rotation of golf club head 1000 about head horizontal axis 1810 when strikeface 1210 hits golf ball 2600 off-center towards head top portion 1120 or head sole portion 1130, thereby increasing the forgiveness of golf club head 1000 for such high or low mis-hits. For instance, to increase horizontal MOI 1811, weight may be added or repositioned towards head front portion 1110 and/or head rear portion 2160. In the same or other examples, golf club head 1000 can be lengthened towards head front portion 1110 and/or head rear portion 2160.

Such adjustments or changes to increase horizontal MOI 1811 can be made up to a point, however, before they start affecting other golf club head characteristics. For example, unrestrained adjustments to increase horizontal MOI 1811 can lead to an undue increase in hosel MOI 1711 if not properly balanced, thereby increasing the resistance of golf club head 1000 to rotate about hosel axis 1710, an thus making it hard for a person to "turn over" the golf club during a golf swing for proper positioning or "squaring" of golf club head 1000 at impact with golf ball 2600. An increase in hosel MOI 1711 also can restrict or reduce a gearing effect between golf ball 2600 and strikeface 1210 that would otherwise impart some corrective spin to golf ball 2600 during off-center impacts.

To reduce hosel MOI 1711, golf club head 1000 can be designed to limit the distance between hosel axis 1710 and any additional or discretionary mass of golf club head 1000. Such approaches to decrease hosel MOI 1711, if not properly balanced, can be incompatible with some of the approaches described above to increase horizontal MOI 1811. Accordingly, weight addition or redistribution for golf club head 1000 to increase horizontal MOI 1811 should be balanced with respect to maintaining or restricting an increase in hosel MOI 1711.

In light of the above, the fourth optimization characteristic of golf club head 1000 controls the relationship between horizontal MOI 1811 and hosel MOI 1711 to satisfy to satisfy Relation 4 below:

$$(\text{Horizontal MOI}_{1811}) \geq 39\% \ (\text{Hosel MOI}_{1711}) \qquad \text{[Relation 4]}$$

There can be examples where golf club head 1000 can be configured so that its fourth optimization characteristic can surpass the requirements of Relation 4. As an example, in some implementations, the fourth optimization characteristic of golf club head 1000 can be configured so that horizontal MOI 1811 is greater than or equal to 40% of hosel MOI 1711, greater than or equal to 45% of hosel MOI 1711, or greater than or equal to 50% of hosel MOI 1711. In the present example, horizontal MOI 1811 is approximately 3740 grams-square-centimeter ($g \cdot cm^2$), but there can be examples where it can range between approximately 2800 $g \cdot cm^2$ to approximately 4300 $g \cdot cm^2$. In many embodiments, the horizontal MOI 1811 can be greater than approximately 2800 $g \cdot cm^2$, greater than approximately 3000 $g \cdot cm^2$, greater than approximately 3200 $g \cdot cm^2$, greater than approximately 3400 $g \cdot cm^2$, greater than approximately 3600 $g \cdot cm^2$, greater than approximately 3800 $g \cdot cm^2$, greater than approximately 4000 $g \cdot cm^2$, or greater than approximately 4200 $g \cdot cm^2$. Hosel MOI 1711 is approximately 9370 $g \cdot cm^2$ in the present example, but can range between approximately 7000 $g \cdot cm^2$ and approximately 11,000 $g \cdot cm^2$ in the same or other examples. In many embodiments, the hosel MOI 1711 can be greater than approximately 7000 g·cm$^2$, greater than approximately 7500 g·cm$^2$, greater than approximately 8000 g·cm$^2$, greater than approximately 8500 g·cm$^2$, greater than approximately 9000 g·cm$^2$, greater than approximately 9500 g·cm$^2$, greater than approximately 10,000 g·cm$^2$, greater than approximately 10,500 g·cm$^2$, or greater than approximately 11,000 g·cm$^2$.

Golf club head 1000 also can comprise a fifth optimization characteristic with respect to a balance between hosel MOI 1711 and vertical MOI 1611 (FIG. 1). Vertical MOI 1611 is defined about head vertical axis 1610, which extends through head center of gravity 2500, from head top portion 1120 to head sole portion 1130, and orthogonal to ground plane 1010 when golf club head 1000 is at the address position. Vertical MOI 1611 is approximately 5300 g·cm$^2$ in the present example, but can range between approximately 4700 g·cm$^2$ and approximately 6000 g·cm$^2$ in the same or other examples. In many embodiments, the vertical MOI 1611 can be greater than approximately 4700 g·cm$^2$, greater than approximately 4900 g·cm$^2$, greater than approximately 5100 g·cm$^2$, greater than approximately 5300 g·cm$^2$, greater than approximately 5500 g·cm$^2$, greater than approximately 5700 g·cm$^2$, or greater than approximately 5900 g·cm$^2$.

In some examples, vertical MOI 1611 can be increased to restrict a rotation of golf club head 1000 about head vertical axis 1610 when strikeface 1210 hits golf ball 2600 off-center towards head heel portion 1140 or towards head toe portion 1150, thereby increasing the forgiveness of golf club head 1000 for such heel-side or toe-side mis-hits. For instance, to increase vertical MOI 1611, weight can be added or repositioned towards head heel portion 1140 and/or head toe portion 1150. In the same or other examples, the golf club head can be lengthened towards head heel portion 1140 and/or head toe portion 1150.

Such adjustments or changes to increase vertical MOI 1611 can be made up to a point, however, before they start affecting other golf club head characteristics. For example, unrestrained adjustments to increase vertical MOI 1611 can lead to undue increase in hosel MOI 1711 if not properly balanced, thereby increasing the resistance of golf club head 1000 to rotate about hosel axis 1710 as described above. In addition, some approaches to decrease hosel MOI 1711, if not properly balanced, can be incompatible with some of the approaches described above to increase vertical MOI 1611. Accordingly, weight addition or redistribution for golf club head 1000 to increase vertical MOI 1611 should be balanced with respect to maintaining or restricting an increase in hosel MOI 1711.

In light of the above, the fifth optimization characteristic of golf club head 1000 controls the relationship between vertical MOI 1611 and hosel MOI 1711 to satisfy Relation 5 below:

$$(\text{Vertical MOI}_{1611}) \geq 59\% \ (\text{Hosel MOI}_{1711}) \qquad \text{[Relation 5]}$$

There can be examples where golf club head 1000 can be configured so that its fifth optimization characteristic can surpass the requirements of Relation 5. As an example, in some implementations, the fifth optimization characteristic of golf club head 1000 can be configured so that vertical MOI 1611 is greater than or equal to 60% of hosel MOI 1711, greater than or equal to 65% of hosel MOI 1711, or greater than or equal to 70% of hosel MOI 1711. In some examples, golf club head 1000 can be configured so that its fourth optimization characteristic satisfies Relation 4, while its fifth optimization characteristic also satisfies Relation 5.

Weight Structure

In some implementations, golf club head 1000 can be configured to exhibit the head CG depth, the head CG height, the first, second, third, fourth, and/or fifth optimization characteristics described above by adjusting a distribution of mass or a relationship between different elements of golf club head 1000. To such ends, golf club head 1000 can comprise weight structure 2700, located towards head sole portion 1130 and head rear portion 2160, as seen in FIGS. 2-3. In some configurations, weight structure 2700 can be designed and/or located to satisfy the constraints imposed by Relation(s) 1, 2, 3, 4, and/or 5, thereby balancing the face height or size of strikeface 1210, head volume 2600, the location of center of gravity 2500, and/or the different moments of inertia of golf club head 1000.

As can be seen in FIG. 3, weight structure 2700 can be located relative to clock grid 3500, which can be aligned with respect to strikeface 1210. For example, clock grid 3500 comprises 12 o'clock ray 3512, which is aligned with strikeface centerpoint 1211 in the present embodiment. 12 o'clock ray 3512 is orthogonal to front intersection line 3271, which is defined by the intersection of loft plane 2270 (FIGS. 2-3) and ground plane 1010 (FIGS. 1-2). Clock grid 3500 can be centered along 12 o'clock ray 3512, at a midpoint between a front end of front portion 1110 and a rear end of rear portion 2160. In the same or other examples, clock grid centerpoint 3515 can be centered proximate to a geometric centerpoint of golf club head 1000. Clock grid 3500 also comprises 3 o'clock ray 3503 extending towards head heel portion 1140, and 9 o'clock ray 3509 extending towards head toe portion 1150.

Weight perimeter 2705 of weight structure 2700 is located in the present embodiment towards head rear portion 2160, at least partially bounded between 4 o'clock ray 3504 and 8 o'clock ray 3508 of clock grid 3500, while weight center 2750 is located between 5 o'clock ray 3505 and 7 o'clock ray 3507. In examples such as the present one, weight perimeter 2705 is fully bounded between 4 o'clock ray 3504 and 8 o'clock ray 3508. Although weight perimeter 2705 is defined external to golf club head 1000 in the present example, there can be other examples where weight perimeter may extend into an interior of, or be defined within, golf club head 1000. In some examples, the location of weight 2700 can be established with respect to a broader area. For instance, in such examples, weight perimeter 2705 of weight structure 2700 can be located towards head rear portion 2160, at least partially bounded between 4 o'clock ray 3504 and 9 o'clock ray 3509 of clock grid 3500, while weight center 2750 can be located between 5 o'clock ray 3505 and 8 o'clock ray 3508.

In the same or other embodiments, weight structure 2700 can extend or be shifted towards heel portion 1140. For instance, weight perimeter 2705 and/or weight center 2750 can be shifted towards 4 o'clock ray 3504 than towards 9 o'clock ray 3509. Biasing weight structure 2700 towards head heel end 1140 can permit a decrease in hosel MOI 1711 about hosel axis 1710 by limiting the distance between hosel axis 1710 and weight structure 2700, thereby allowing easier turning of golf club head 1000 about hosel axis 1710 during a swing.

In some examples, weight structure 2700 can comprise a mass of approximately 2 grams to approximately 50 grams, and/or a volume of approximately 1 cc to approximately 30 cc. In the present example, weight structure 2700 protrudes from the external contour of head sole portion 1130, and is thus at least partially external to allow for greater adjustment of head center of gravity 2500.

Weight structure 2700 can comprise removable weight 2790 in the same or other examples, where removable weight 2790 can comprise a mass of approximately 0.5 grams to approximately 30 grams, and can be replaced with one or more other similar weights to adjust the location of head center of gravity 2500 if needed to satisfy Relation(s) 1, 2, 3, 4, and/or 5. In the same or other examples, weight center 2750 can comprise at least one of a center of gravity of weight structure 2700, a center of gravity of removable weight 2790, a geometric center of weight structure 2700, and/or a geometric center of removable weight 2790.

Weight center 2750 can be located with respect to ground plane 1010 and weight center elevation axis 2340, which extends between weight center 2750 and ground plane 1010. Weight center elevation axis 2340 is orthogonal to ground plane 1010 when golf club head 1000 is at the address position. Weight center elevation 2730 for weight center 2750 can thus be measured along weight center elevation axis 2340, between weight center 2750 and ground plane 1010. In addition, weight center depth 2710 for weight center 2750 can be measured, parallel to ground plane 1010, between intersection points 2802 and 2804. In the present example, intersection point 2804 is defined by the intersection between ground plane 1010 and weight center elevation axis 2340 when golf club head 1000 is at the address position. Weight center 2750 can be located in the same or other embodiments such that weight distance 2751 (FIG. 2), which separates head center of gravity 2500 from weight center 2750, can be approximately 25 mm to approximately 102 mm.

There can also be embodiments where face portion 1200 can comprise a reduced thickness, which may be reinforced as needed with one or more reinforcing structures at the backside of strikeface 1210 and/or at the junction between face portion 1200 and head front portion 1110. Other mass redistribution mechanisms can be employed as well if desired to satisfy Relation(s) 1, 2, 3, 4, and/or 5.

In some implementations, a relationship or ratio between head center of gravity 2500 and weight center 2750 can be configured to permit one or more or Relation(s) 1, 2, 3, 4, or 5 to be satisfied. For example, an elevation ratio, defined by the ratio of weight center elevation 2730 over head CG elevation 2530, can be greater than 0.44 to help maintain head center of gravity 2500 closer to head sole portion 1130. As another example, a depth ratio, defined by the ratio of weight center depth 2710 over head CG depth 2510, can be less than 2.54 to preventing CG depth 2510 from unduly decreasing towards head front portion 1110. There can be some implementations where head CG elevation 2530 can be less than approximately 28.5 mm, where weight center elevation 2730 can be less than approximately 12.5 mm, and/or where weight center depth 2710 can be greater than approximately 99.7 mm.

In the same or other embodiments, the distribution of mass within golf club head 1000 can further be adjusted such that golf club head 1000 is configured to exhibit the first, second, third, fourth, and/or fifth optimization characteristics described above. To such ends, golf club head 1000 can comprise one or more weight members comprised of an adhesive material, distributed towards head sole portion 1130. The one or more weight members can be disposed on an inner surface of head sole portion 1130. In some configurations, the one or more weight members can be designed and/or located to satisfy the constraints imposed by Relation(s) 1, 2, 3, 4, and/or 5, thereby balancing the face height or size of strikeface 1210, head volume 2600, the location of center of gravity 2500, and/or the different moments of inertia of golf club head 1000.

In some examples, each of the one or more weight members can comprise a mass of approximately 2 grams to approximately 50 grams, and/or a volume of approximately 1 cc to approximately 30 cc. In some configurations, the one or more weight members can comprise a gluing agent, such as an acrylic or epoxy-based resin adhesive. The one or more weight members can optionally be comprised of a mixture of a gluing agent and a metallic powder. Alternatively, the one or more weight members can comprise a combination of an adhesive and one or more mass elements. Each of the one or more mass elements can weigh between approximately 0.5 grams and approximately 30 grams. In some examples, each of the one or more mass elements can comprise a uniform material, such as metal, metal alloy, or some other material having high density.

In addition to adjusting the distribution of mass within golf club head 1000 such that golf club head 1000 is configured to exhibit the first, second, third, fourth, and/or fifth optimization characteristics described above, the one or more weight members can impart golf club head 1000 with additional performance benefits. In some examples, the adhesive material comprising the one or more weight members can maintain its sticky or adhesive properties such that loose fragments within club head 1000 will adhere to the one or more weight members during use of golf club head 1000. In the same or other examples, the one or more weight members disposed on the inner surface of head sole portion 1130 can provide vibration damping and/or sound attenuation during impact of golf club head 1000 with golf ball 2900. In the same or further examples, the one or more weight members can be located on the inner surface of head sole portion 1130 in certain positions, and in certain quantities, such that desirable acoustic characteristics of golf club 1000 may be achieved during impact with golf ball 2900.

Thin Regions

In some embodiments, golf club head 1000 can be configured to exhibit the head CG depth, the head CG height, the first, second, third, fourth, and/or fifth optimization characteristic described above by adjusting a distribution of mass or a relationship between different elements of golf club head 1000. To such ends, golf club head 1000 can comprise one or more thin regions, located in various regions of club head 1000. The club head 1000 can include thin regions instead of or in addition to the weight structure 2700. Thin regions increase discretionary weight of golf club head 1000, such that the added discretionary weight can be positioned within the weight structure, on an inner or outer peripheral surface of club head 1000, and/or other areas of club head 1000 to achieve the first, second, third, fourth, and/or fifth performance characteristic.

The thin regions can be positioned on any region of the club head 1000. For example, the thin regions can be positioned on one or more of the head top portion 1120, head sole portion 1130, head heel portion 1140, head toe portion 1150, head rear portion 2160, or face portion 1200.

In many embodiments, the thin regions comprise a thickness less than approximately 0.020 inches. In other embodiments, the thin regions comprise a thickness less than 0.025 inches, less than 0.020 inches, less than 0.015 inches, or less than 0.010 inches. For example, the thin regions can comprise a thickness between approximately 0.010-0.025 inches, between approximately 0.015-0.020 inches, between approximately 0.016-0.020 inches, between approximately 0.017-0.020 inches, or between approximately 0.018-0.020 inches In the illustrated embodiment, the thin regions vary in shape and position and cover approximately 25% of the surface area of club head 1000. In other embodiments, the thin regions can cover approximately 20-30%, approximately 15-35%, approximately 15-25%, approximately 10-25%, approximately 15-30%, or approximately 20-50% of the surface area of club head 1000. Further, in other embodiments, the thin regions can cover up to 5%, up to 10%, up to 15%, up to 20%, up to 25%, up to 30%, up to 35%, up to 40%, up to 45%, or up to 50% of the surface area of club head 1000.

In many embodiments, a portion of the thin regions are positioned on the head top portion 1120 such that approximately 51% of the surface area of the head top portion 1120 comprises thin regions. In other embodiments, at least a portion of the thin regions can be positioned on the head top portion 1120 such that up to 20%, up to 25%, up to 30%, up to 35%, up to 40%, up to 45%, up to 50%, up to 55%, up to 60%, up to 65%, up to 70%, or up to 75% of the head top portion 1120 comprises thin regions. For example, in some embodiments, approximately 40-60% of the head top portion 1120 can comprise thin regions. For further example, in other embodiments, approximately 35-65%, approximately 30-70%, or approximately 25-75% of the head top portion 1120 can comprise thin regions.

In many embodiments, a portion of the thin regions are positioned on the head sole portion 1130 such that approximately 64% of the surface area of the head sole portion 1130 comprises thin regions. In other embodiments, at least a portion of the thin regions can be positioned on the head sole portion 1130 such that up to 20%, up to 25%, up to 30%, up to 35%, up to 40%, up to 45%, up to 50%, up to 55%, up to 60%, up to 65%, up to 70%, or up to 75% of the head sole portion 1130 comprises thin regions. For example, in some embodiments, approximately 40-60% of the head sole portion 1130 can comprise thin regions. For further example, in other embodiments, approximately 35-65%, approximately 30-70%, or approximately 25-75% of the head sole portion 1130 can comprise thin regions.

In many embodiments, club head 1000 having thin regions can be manufacturing using centrifugal casting. In other embodiments, portions of club head 1000 having thin regions can be manufactured using other suitable methods, such as stamping, forging, or machining. In embodiments where portions of the club head 1000 having thin regions are manufactured using stamping, forging, or machining, the portions of the club head 1000 can be coupled using epoxy, tape, welding, mechanical fasteners, or other suitable methods.

Fixed Weight

Figure 8:
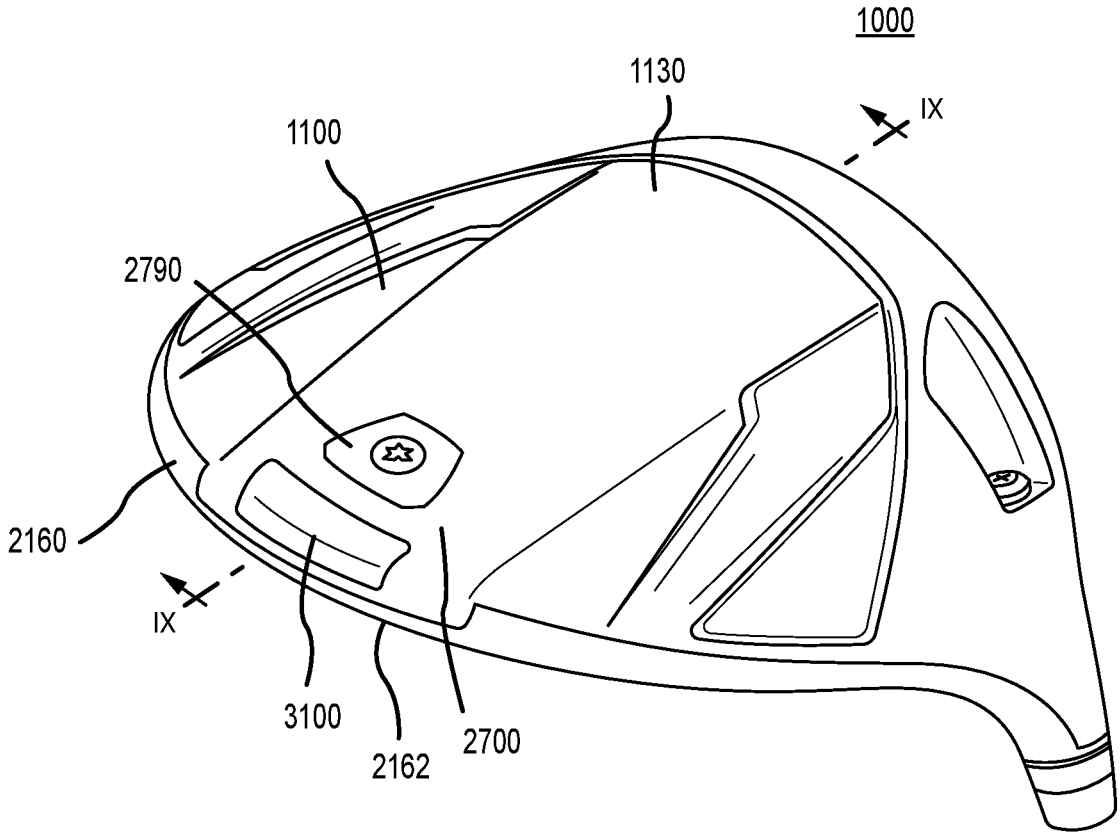
FIG. 8 illustrates a rear perspective view of the golf club head in accordance with the present disclosure.
Figure 9:
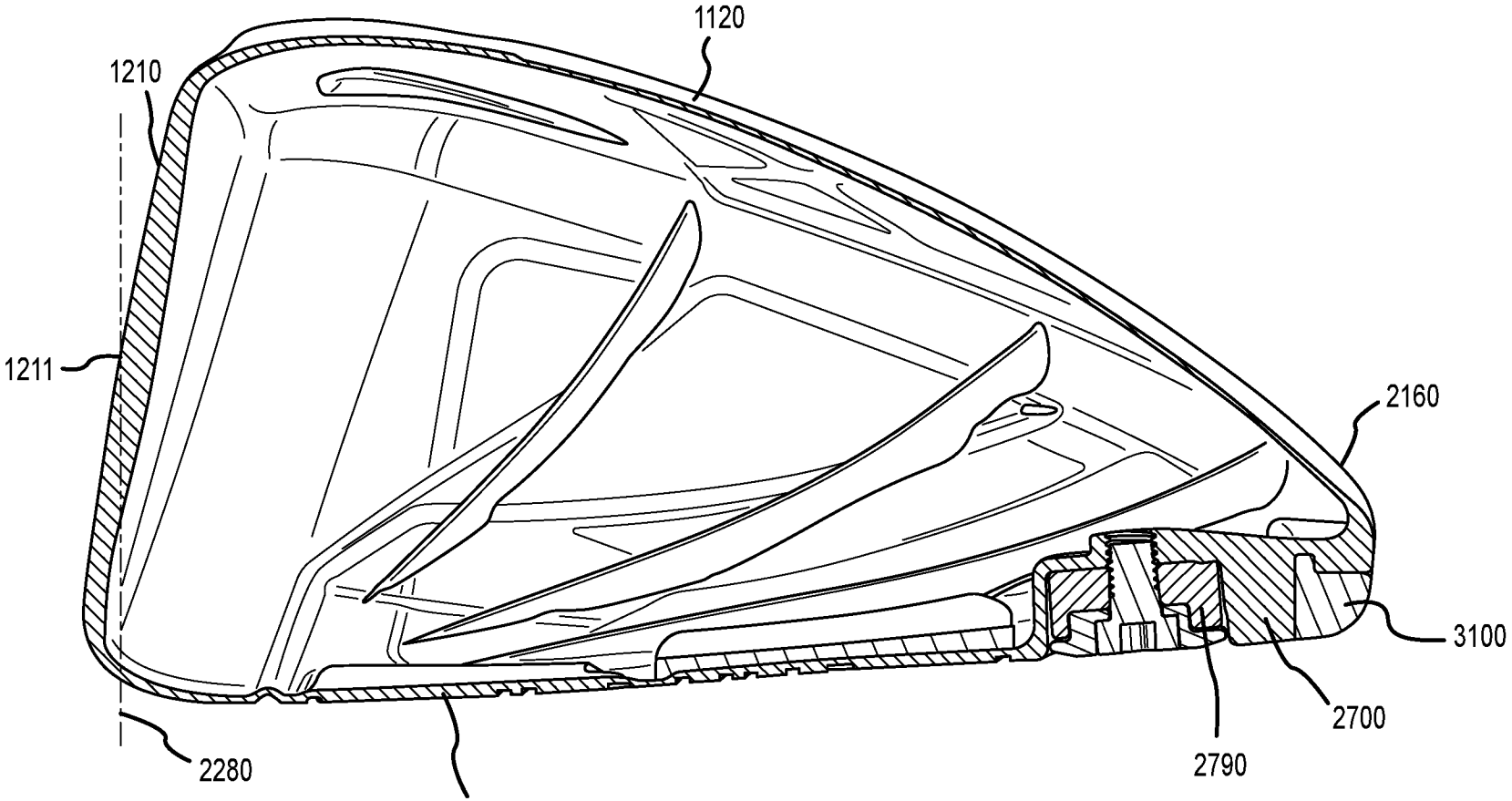
FIG. 9 illustrates a side cross-sectional view of the golf club head along line IX-IX of FIG. 8.

In some embodiments, golf club head 1000 can be configured to exhibit the head CG depth, the head CG height, the first, second, third, fourth, and/or fifth optimization characteristic described above by adjusting a distribution of mass or a relationship between different elements of golf club head 1000. To such ends, golf club head 1000 can comprise one or more fixed weights 3100 having a specific gravity greater than the specific gravity of the body, as illustrated in FIGS. 8 and 9. The club head 1000 can include the one or more fixed weights 3100 instead of or in addition to the weight structure 2700. Further, the club head 1000 can include the one or more fixed weights 3100 instead of or in addition to the thin regions. Further, in embodiments where the club head includes one or more fixed weights 3100 in addition to the weight structure 2700, the one or more fixed weights 3100 can be located within the weight structure 2700, or the one or more fixed weights 3100 can be located outside of, or separate from the weight structure 2700.

In these or other embodiments, referring to FIGS. 8 and 9, the one or more fixed weights 3100 are positioned on the sole of the club head near the perimeter 2162 of the head rear portion 2160 of the club head 1000. For example, in many embodiments, the one or more fixed weights 3100 are positioned within 1.0 inch from the perimeter 2162 of the head rear portion 2160. In other embodiments, the one or more fixed weights 3100 can be positioned within 0.25, 0.5, 0.75, 1.0, 1.25, 1.5, 1.75, or 2.0 inches from the perimeter 2162 of the head rear portion 2160.

Further, in these or other embodiments, the one or more fixed weights 3100 can be positioned a distance from the front plane 2280 of the club head 1000 greater than 3.75 inches, greater than 4.0 inches, greater than 4.25 inches, greater than 4.50 inches, or greater than 4.75 inches. Further still, in these or other embodiments, the one or more fixed weights 3100 can be positioned a distance from the head CG 2500 of the club head 1000 greater than 1.5 inches, greater than 1.75 inches, greater than 2.0 inches, greater than 2.25 inches, or greater than 2.5 inches.

The body 1100 of the club head 1000 comprises a first material. The one or more fixed weights 3100 comprise a second high density material, such as tungsten, gold, hafnium, iridium, mercury, neptunium, osmium, palladium, platinum, plutonium, protactinium, rhenium, rhodium, ruthenium, tantalum, uranium, or any other high density material. In many embodiments, the second material has a specific gravity greater than 12.0. In other embodiments, the second material can have a specific gravity greater than 10.0, greater than 11.0, greater than 12.0, greater than 13.0, greater than 14.0, greater than 15.0, greater than 16.0, greater than 17.0, or greater than 18.0. For example, in some embodiments, the second material can have a specific gravity between 10.0 and 18.0, between 12.0 and 18.0, or between 14.0 and 18.0.

In many embodiments, one or more of the fixed weights 3100 can comprise a mass greater than 12 grams. In other embodiments, one or more of the fixed weights 3100 can comprise a mass greater than 8 grams, greater than 9 grams, greater than 10 grams, greater than 11 grams, or greater than 12 grams.

In some embodiments, the fixed weight 3100 can be formed integrally with the body of the club head by casting, comolding, or any other suitable method. In other embodiments, the fixed weight 3100 can be formed separately from the body of the club head and coupled to the club head by welding (e.g. with the fixed weight sintered to a less dense, weldable material), brazing, adhesives (such as epoxy), rivets, screws, or any other suitable method. In many embodiments, the one or more fixed weights are permanently coupled to the club head. In other embodiments, the one or more fixed weights can be removably coupled to the club head.

Relative Mass Properties

Various embodiments of the mass properties of the golf club head 1000 are described below to relative to exemplary driver, fairway wood, and hybrid type golf club heads, to achieve the above described head CG depth, the head CG height, the first, second, third, fourth, and/or fifth optimization characteristic.

In many embodiments, the golf club head 1000 can include a first rear region comprising a portion of the rear end of the club head 1000 located within the last or rearmost 20% of the length 2910 of the club head 1000. Further, golf club head 1000 can include a second rear region comprising a portion of the rear end of the club head 1000 located within the last or rearmost 10% of the length 2910 of the club head 1000. In these or other embodiments, the length 2910 of the club head 1000 is the greatest distance from the leading edge 2912 to the rear end of the club head measured in a direction from the face portion 1200 to the head rear portion 2160, perpendicular to the front plane 2280.

An exemplary driver type club head 1000 can have a volume greater than approximately 400 cc, and a golf club length greater than 44 inches. In other embodiments, the exemplary driver type club head can comprise a volume greater than 400 cc, greater than 410 cc, greater than 420 cc, greater than 430 cc, greater than 440 cc, or greater than 450 cc. Further, in other embodiments, the exemplary driver type club head can comprise a golf club length greater than 44 inches, greater than 45 inches, greater than 46 inches, or greater than 47 inches. Further still, in other embodiments, the exemplary driver type club head can comprise a golf club length between 44-48 inches, between 45-48 inches, or between 46-48 inches.

In many embodiments of the exemplary driver type club head, the first material of the body 1100 comprises a titanium alloy such as Ti-6-4 or Ti-9s. In other embodiments, the first material of the body 1100 can comprise any suitable material having a specific gravity less than 5.0. For example, the first material of the body 1100 can comprise titanium, aluminum, barium, beryllium, scandium, strontium, or yttrium. In many embodiments of an exemplary driver type club head, the ratio of the specific gravity of the first material of the body to the specific gravity of the second material of the weight is less than approximately 0.4. In other embodiments of an exemplary driver type club head, the ratio of the specific gravity of the first material of the body to the specific gravity of the second material of the weight can be less than approximately 0.6, less than approximately 0.5, less than approximately 0.4, less than approximately 0.3, or less than approximately 0.2. Further, in other embodiments of an exemplary driver type club head, the ratio of the specific gravity of the first material of the body to the specific gravity of the second material of the weight can range from approximately 0.35-0.45, from approximately 0.3-0.5, or from approximately 0.2-0.6.

In the illustrated embodiment of the exemplary driver type club head, the first rear region comprises approximately 20.6% of the total mass of the club head 1000. In other embodiments, the first rear region of a driver type club head 1000 can comprise greater than 15%, greater than approximately 16%, greater than approximately 17%, greater than approximately 18%, greater than approximately 19%, greater than approximately 20%, greater than approximately 22.5%, or greater than approximately 25% of the total mass of the club head 1000. Further, in other embodiments, the first rear region of the driver type club head can comprise between 15-20%, between 17.5-25%, or between 20-30% of the total mass of the club head 1000.

In the illustrated embodiment of the exemplary driver type club head, the second rear region comprises approximately 10.0% of the total mass of the club head 1000. In other embodiments, the second rear region of a driver type club head 1000, can comprise greater than approximately 5%, greater than approximately 6%, greater than approximately 7%, greater than approximately 8%, greater than approximately 9%, greater than approximately 10%, greater than approximately 12.5%, or greater than approximately 15% of the total mass of club head 1000. Further, in other embodiments, the second rear region of a driver type club head can comprise between 5-10%, between 7.5-15%, or between 10-20% of the total mass of the club head 1000.

An exemplary fairway wood or hybrid type club head can have a volume less than approximately 400 cc, and a golf club length less than 44 inches. In other embodiments, the exemplary fairway wood or hybrid type club head can comprise a volume less than 420 cc, less than 410 cc, less than 400 cc, less than 390 cc, less than 380 cc, or less than 370 cc. In some embodiments of the exemplary fairway wood type club head, the volume of the club head can be approximately 300 cc-400 cc, approximately 325 cc-400 cc, approximately 350 cc-400 cc, approximately 250 cc-400 cc, approximately 250-350 cc, or approximately 275-375 cc. In some embodiments of the exemplary hybrid type club head, the volume of the club head can be approximately 100 cc-150 cc, approximately 75 cc-150 cc, approximately 100 cc-125 cc, or approximately 75 cc-125 cc. Further, in other embodiments, the exemplary fairway wood or hybrid type club head can comprise a golf club length less than 45 inches, less than 44 inches, less than 43 inches, or less than 42 inches. Further still, in other embodiments, the exemplary fairway wood or hybrid type club head can comprise a golf club length between 40-44 inches, between 37-40 inches, or between 35-40 inches.

In many embodiments of the exemplary fairway wood or hybrid type club head, the first material of the body 1100 comprises a steel alloy. In other embodiments, the first material of the body 1100 can comprise any suitable material having a specific gravity less than 10.0. For example, the first material of the body 1100 can comprise titanium, aluminum, barium, bismuth, cadmium, cerium, chromium, cobalt, copper, dysprosium, europium, gadolinium, gallium, holmium, indium, iron, steel, steel alloys, lanthanum, lutetium, neodymium, nickel, niobium, polonium, praseodymium, promethium, terbium, thulium, tin, vanadium, zinc, zirconium, beryllium, scandium, strontium, or yttrium. In many embodiments of an exemplary fairway wood or hybrid type club head, the ratio of the specific gravity of the first material of the body to the specific gravity of the second material of the weight is less than approximately 0.8. In other embodiments of an exemplary fairway wood or hybrid type club head, the ratio of the specific gravity of the first material of the body to the specific gravity of the second material of the weight can be less than approximately 0.9, less than approximately 0.8, less than approximately 0.7, less than approximately 0.6, or less than approximately 0.5. Further, in other embodiments of an exemplary fairway wood or hybrid type club head, the ratio of the specific gravity of the first material of the body to the specific gravity of the second material of the weight can range from approximately 0.75-0.85, from approximately 0.7-0.9, or from approximately 0.3-0.9.

In embodiments of the club head 1000 comprising a fairway wood type club head, the first rear region can comprise greater than approximately 13%, greater than approximately 14%, greater than approximately 15%, greater than approximately 16%, greater than approximately 17%, greater than approximately 18%, greater than approximately 19%, greater than approximately 20%, greater than approximately 22.5%, greater than approximately 25% of the total mass of the club head 1000. Further, in other embodiments, the first region of the fairway wood type club head can comprise between 13-20%, between 17.5-25%, or between 20-30% of the total mass of the club head 1000. For example, in one embodiment of a fairway wood type club head, the first rear region comprises approximately 20.0% of the total mass of the club head 1000.

In the same or other embodiments of the club head 1000 comprising a fairway wood type club head, the second rear region can comprise greater than approximately 5%, greater than approximately 6%, greater than approximately 7%, greater than approximately 8%, greater than approximately 9%, greater than approximately 10%, greater than approximately 11%, greater than approximately 12%, greater than approximately 15%, greater than approximately 18%, greater than approximately 21% of the total mass of club head 1000. Further, in other embodiments, the second rear region of the fairway wood type club head can comprise between 5-10%, between 7.5-15%, between 12.5-20%, or between 17.5-25% of the total mass of the club head 1000. For example, in one embodiment of a fairway wood type club head, the second rear region comprises approximately 8% of the total mass of the club head 1000.

In embodiments of the club head 1000 comprising a hybrid type club head, the first rear region can comprise greater than approximately 12.5%, greater than approximately 15%, greater than approximately 16%, greater than approximately 17%, greater than approximately 18%, greater than approximately 19%, greater than approximately 20%, greater than approximately 22.5%, greater than approximately 25% of the total mass of the club head 1000. Further, in other embodiments, the first rear region of the hybrid type club head can comprise between 12.5-20%, between 15-20%, between 17.5-25%, or between 20-30% of the total mass of the club head 1000. For example, in one embodiment of a hybrid type club head, the first rear region comprises approximately 17.5% of the total mass of the club head 1000.

In the same or other embodiments of the club head 1000 comprising a hybrid type club head, the second rear region can comprise greater than approximately 3%, greater than approximately 4%, greater than approximately 5%, greater than approximately 6%, greater than approximately 7%, greater than approximately 8%, greater than approximately 9%, greater than approximately 12%, greater than approximately 15% of the total mass of the club head 1000. Further, in other embodiments, the second rear region of the hybrid type club head can comprise between 3-7.5%, between 5-10%, between 7.5-15%, or between 12-20% of the total mass of the club head 1000. For example, in one embodiment of a hybrid type club head, the second rear region comprises approximately 6% of the total mass of the club head 1000.

Crown Angle

In some embodiments, golf club head 1000 can be configured to exhibit the head CG depth, the head CG height, the first, second, third, fourth, and/or fifth optimization characteristic described above by adjusting a distribution of mass or a relationship between different elements of golf club head 1000. To such ends, golf club head 1000 can comprise a steep crown angle 1660 near the center region, heel portion 1140 and/or the toe portion 1150 of the club head 1000. In many embodiments, the steep crown angle 1660 can aid in lowering the position of the head CG height 2510 and/or increasing the head CG depth 2520.

The club head 1000 can include the steep crown angle 1660 instead of or in addition to the weight structure 2700. Further, the club head 1000 can include the steep crown angle 1660 instead of or in addition to the thin regions. Further still, the club head 1000 can include the steep crown angle 1660 instead of or in addition to the one or more fixed weights 3100.

Figure 5:
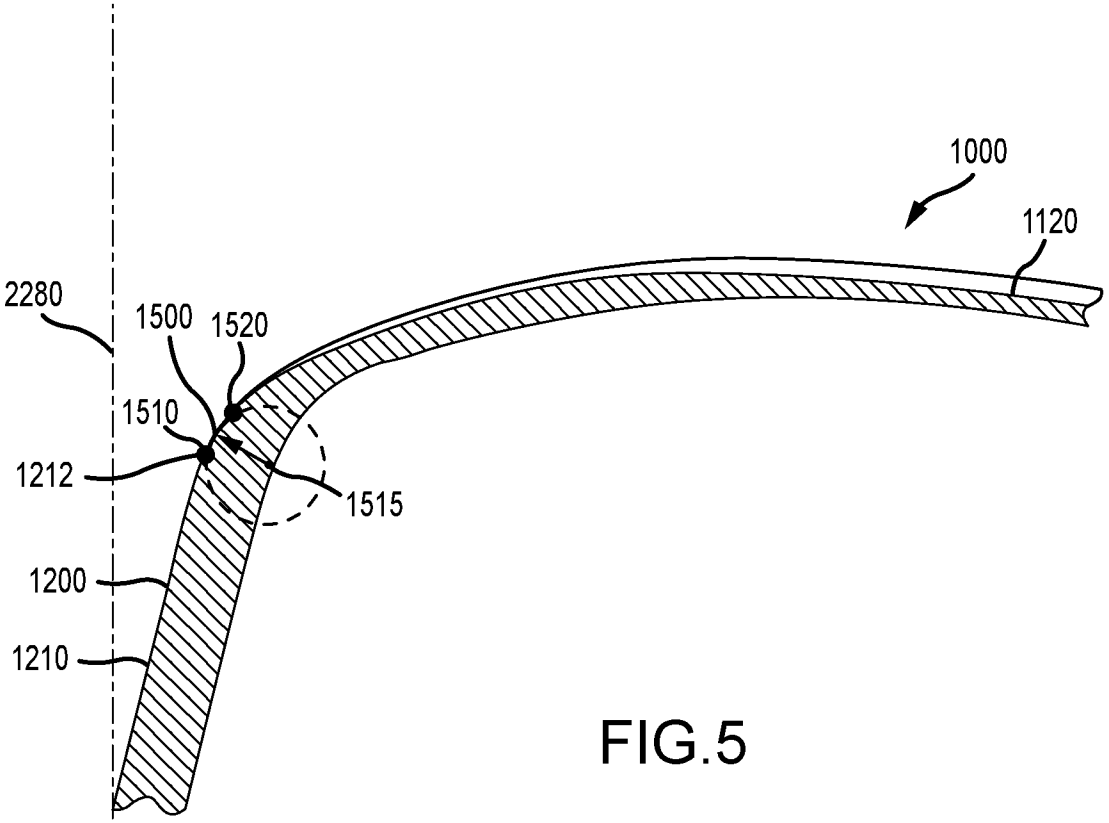
FIG. 5 illustrates a side cross-sectional view of the top transition boundary of the golf club head along line II-II of FIG. 1.

The steep crown angle 1660 is defined relative to various points and axes on the top transition boundary and rear transition boundary of the club head, as described below. Referring to FIG. 5, the top transition boundary extends between the strikeface perimeter 1212 and the head top portion 1120 of the golf club head 1000, from near the head heel portion 1140 to near the head toe portion 1150. The strikeface perimeter 1212 can be defined along a transition boundary where a contour of face portion 1200 departs from the roll radius and/or the bulge radius of strikeface 1210. The top transition boundary includes a top transition boundary profile 1500 when viewed from a side cross sectional view. In these embodiments, the side cross sectional view of the top transition boundary profile 1500 can be taken along any point of the club head 1000 from near the head heel portion 1140 to near the head toe portion 1150.

The top transition boundary profile 1500 includes a top portion radius of curvature 1515. The top portion radius of curvature 1515 is defined by a first top transition point 1510 and a second top transition point 1520. The first top transition point 1510 is positioned on the top transition boundary where the contour of the club head 1000 departs from the roll radius and/or the bulge radius of the strikeface 1210 (i.e. on the strikeface perimeter 1212). The second top transition point 1520 is positioned along the top transition boundary where the profile deviates from the top portion radius of curvature 1515. The first top portion radius of curvature 1515 extends from the first top transition point 1510 to the second top transition point 1520.

Referring to FIG. 5, in the illustrated embodiment, the top portion radius of curvature 1515 is substantially constant from the head heel portion 1140 to the head toe portion 1150 of the club head 1000. In other embodiments, the top portion radius of curvature 1515 may vary from the heel portion 1140 to the toe portion 1150 of the club head 1000. For example, the top portion radius of curvature 1515 may be greater towards the head heel portion 1140 of the club head 1000, toward the head toe portion 1150 of the club head 1000, in the center of the club head 1000, or in any combination of the above described positions. The top portion radius of curvature 1515 may vary from the head heel portion 1140 to the head toe portion 1150 according to any profile, such as, for example, linear, parabolic, quadratic, exponential, or any other profile.

In the illustrated embodiment, the top transition boundary profile 1500 has two transition points and one radii of curvature. In other embodiments, the top boundary transition profile 1500 may include any number of transition points, and any number of radii of curvature. For example, the top transition boundary profile 1500 may include one, two, three, four, five, six, seven, eight, nine, ten, or any number of transition points. For further example, the top transition boundary profile 1500 may include one, two, three, four, five, six, seven, eight, nine, ten, or any number of radii of curvature.

Figure 6:
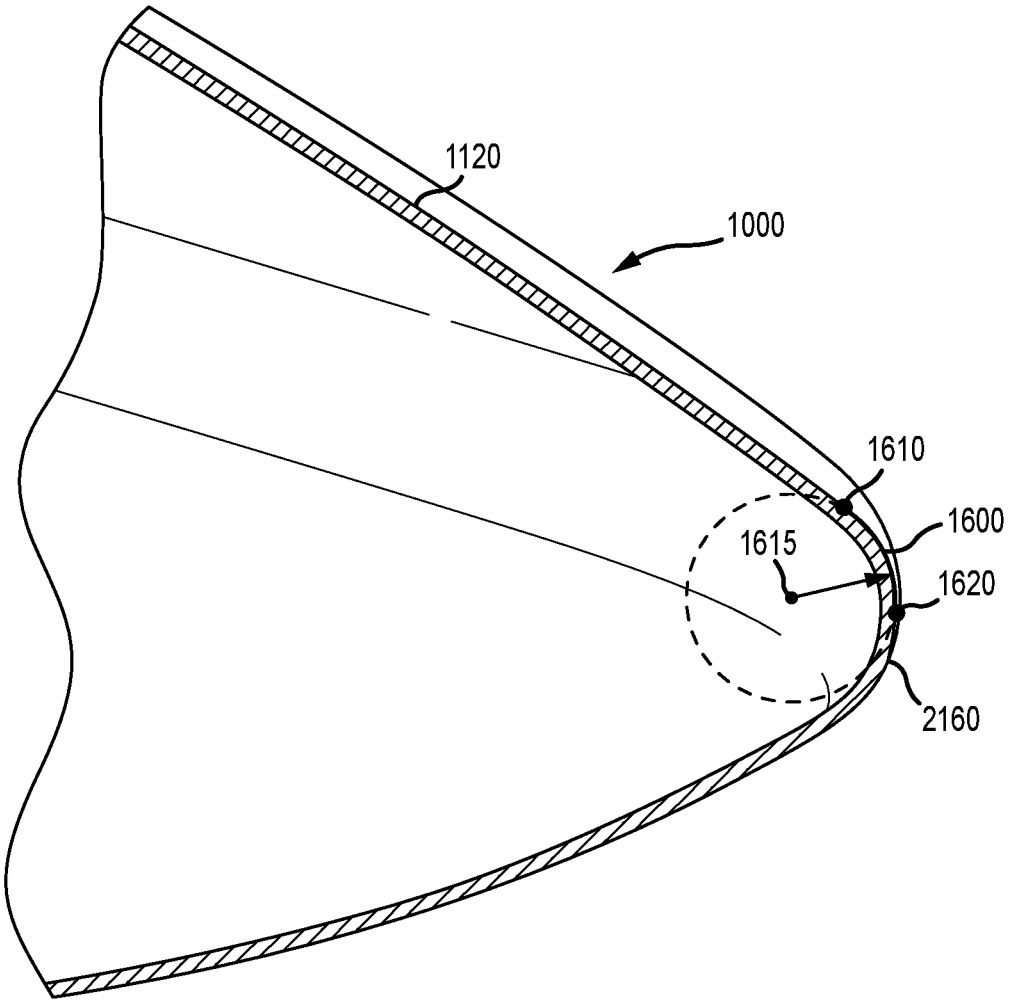
FIG. 6 illustrates a side cross-sectional view of the rear transition boundary of the golf club head along line II-II of FIG. 1.

Referring to FIG. 6, a rear transition boundary extends between the head rear portion 2160 and the head top portion 1120 of the golf club head 1000, from near the head heel portion 1140 to near the head toe portion 1150. The rear transition boundary includes a rear transition boundary profile 1600 when viewed from a side cross sectional view. In these embodiments, the side cross sectional view of the rear transition boundary profile 1600 can be taken along any point of the club head 1000 from near the head heel portion 1140 to near the head toe portion 1150.

The rear transition profile 1600 further includes a rear radius of curvature 1615 positioned between a first rear transition point 1610 and a second rear transition point 1620. In the illustrated embodiment, the first rear transition point 1610 is located at an edge of the head top portion 1120 near the head rear portion 2160 where the curvature of the head top portion 1120 deviates in the cross sectional view. In the same or other embodiments, the first rear transition point 1610 can be located on the rear transition profile of the club head 1000 in the cross sectional view where the rear radius of curvature 1615 starts. The second rear transition point 1620 is located on the head rear portion 2160 of the club head 1000 in the cross sectional view where the rear radius of curvature 1615 ends.

In the illustrated embodiment, the rear radius of curvature 1615 is substantially constant from the head heel portion 1140 to the head toe portion 1150 along the head rear portion 2160 of the golf club head 1000. In other embodiments, the rear radius of curvature 1615 may vary from the head heel portion 1140 to the head toe portion 1150 along the head rear portion 2160 of the golf club head 1000. The rear radius of curvature may be greater near the head heel portion 1140, near the head toe portion 1150, near the center of the golf club head 1000, or any combination of the above described positions. For example, the rear radius of curvature 1615 may be greater near the head heel portion 1140 and the head toe portion 1150 than in the center of the head rear portion 2160 of the golf club head 1000. The rear radius of curvature 1615 may vary from the head heel portion 1140 to the head toe portion 1150 according to any profile, such as, for example, linear, parabolic, quadratic, exponential, or any other profile.

In the illustrated embodiment, the rear transition profile 1600 has two rear transition points and one radius of curvature. In other embodiments, the rear transition profile may include any number of rear transition points, and any number of radii of curvature. For example, the rear transition profile 1600 may include one, two, three, four, five, six, seven, eight, nine, ten, or any number of rear transition points. For further example, the rear transition profile 1600 may include one, two, three, four, five, six, seven, eight, nine, ten, or any number of radii of curvature.

Figure 7:
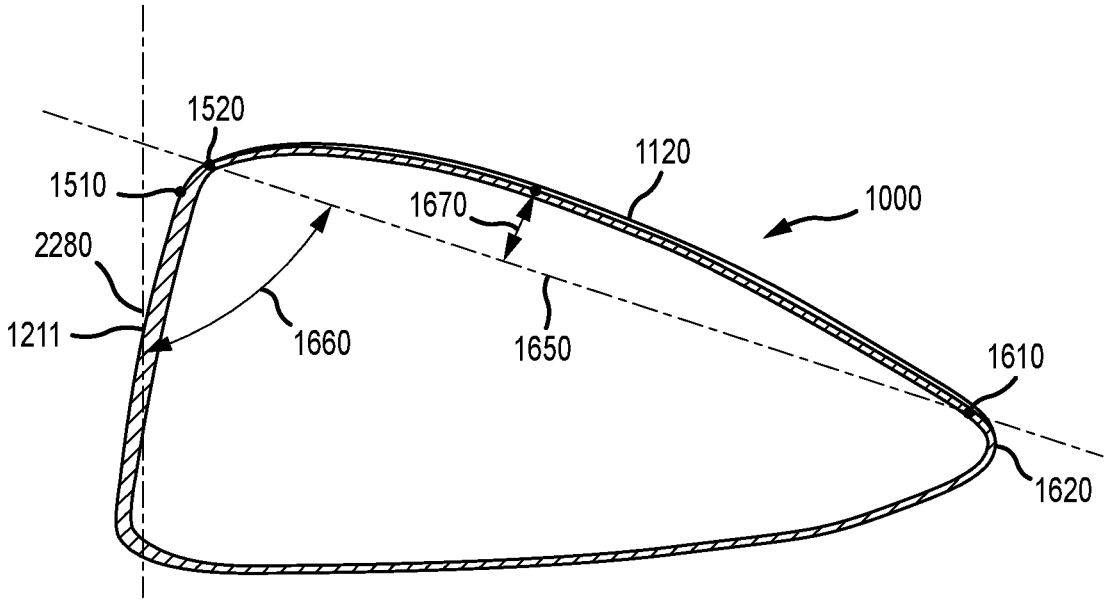
FIG. 7 illustrates a side cross-sectional view of the golf club head along line II-II of FIG. 1.

Referring to FIG. 7, the head top portion 1120 of the golf club head 1000 further includes a crown axis 1650 when viewed from a side cross sectional view. In these embodiments, the side cross sectional view can be taken along any point of the club head 1000 from near the head heel portion 1140 to near the head toe portion 1150. The crown axis 1650 extends through the second top transition point 1520 and the first rear transition point 1610.

The crown axis 1650 intersects with the front plane 2280 at a point in front of the golf club head 1000. The crown angle 1660 is defined as the acute angle between the crown axis 1650 and the front plane 2280. The crown angle 1660 can vary when the side cross sectional view is taken at different locations relative to the head heel portion 1140 and/or the head toe portion 1150.

In the illustrated embodiment, the crown angle 1660 near the head toe portion 1150 is approximately 72.25 degrees, the crown angle 1660 near the head heel portion 1140 is approximately 64.5 degrees, and the crown angle 1660 near the center of the golf club head 1000 is approximately 64.2 degrees. In other embodiments, the crown angle 1660 near the head toe portion 1150 of the club head 1000 can be less than approximately 79 degrees, less than approximately 78 degrees, less than approximately 77 degrees, less than approximately 76 degrees, less than approximately 75 degrees, less than approximately 74 degrees, less than approximately 73 degrees, less than approximately 72 degrees, less than approximately 71 degrees, less than approximately 70 degrees, less than approximately 69 degrees, or less than approximately 68 degrees. For example, the crown angle 1660 measured in a side cross sectional view of the club head taken through a point positioned approximately 1.0 inch toward the head toe portion 1150 from the geometric centerpoint of the strikeface can be less than 79 degrees, less than 78 degrees, less than 77 degrees, less than 76 degrees, less than 75 degrees, less than 74 degrees, less than 73 degrees, less than 72 degrees, less than 71 degrees, less than 70 degrees, less than 69 degrees, or less than 68 degrees.

In some embodiments, the crown angle 1660 near the head heel portion 1140 can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees. For example, the crown angle 1660 measured in a side cross sectional view of the club head taken through a point positioned approximately 1.0 inch toward the head heel portion 1140 from the geometric centerpoint of the strikeface can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees.

In some embodiments, the crown angle 1660 near the center of the club head 1000 can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees. For example, the crown angle 1660 measured in a side cross sectional view of the club head taken through the geometric centerpoint of the strikeface can be less than approximately 70 degrees, less than approximately 69 degrees, less than approximately 68 degrees, less than approximately 67 degrees, less than approximately 66 degrees, less than approximately 65 degrees, less than approximately 64 degrees, less than approximately 63 degrees, less than approximately 62 degrees, less than approximately 61 degrees, less than approximately 60 degrees, less than approximately 59 degrees.

In many embodiments, reducing the crown angle 1660 compared to current club heads generates a steeper head top portion 1120 or a head top portion 1120 positioned closer to the ground. Accordingly, the reduced crown angle 1660 can result in a lower head CG position.

In some embodiments, reducing the crown angle 1660 to form a steeper head top portion 1120 and lower head CG position may result in an undesired increase in aerodynamic drag. To prevent increased drag associated with a steeper head top portion 1120, a maximum head top portion height 1670 can be increased. Referring again to FIG. 7, the maximum head top portion height 1670, defined as the greatest distance between the head top portion 1120 and the crown axis 1650 taken at any side cross sectional view. In many embodiments, a greater head top portion height 1670 results in the head top portion 1120 having a greater curvature. A greater curvature in the head top portion 1120 moves the location of the airflow separation during a swing further back on the club head 1000. In other words, a greater curvature allows the airflow to stay attached to club head 1000 for a longer distance across the head top portion 1120 as the club is swung. Moving the airflow separation point back on the golf club head 1000 can result in less drag and faster club head speeds.

In some embodiments the maximum head top portion height 1670 can be approximately 16.5 mm (or approximately 0.65 inches). In other embodiments, the maximum head top portion height 1670 can be greater than approximately 5 mm, greater than approximately 7.5 mm, greater than approximately 10 mm, greater than approximately 12.5 mm, greater than approximately 15 mm, greater than approximately 17.5 mm, greater than approximately 20 mm, greater than approximately 22.5 mm, or greater than approximately 25 mm. Further, in other embodiments, the maximum head top portion height 1670 can be within the range of 5 mm to 15 mm, or 10 mm to 20 mm, or 15 mm to 25 mm.

Method to Manufacture Club Head

Figure 4:
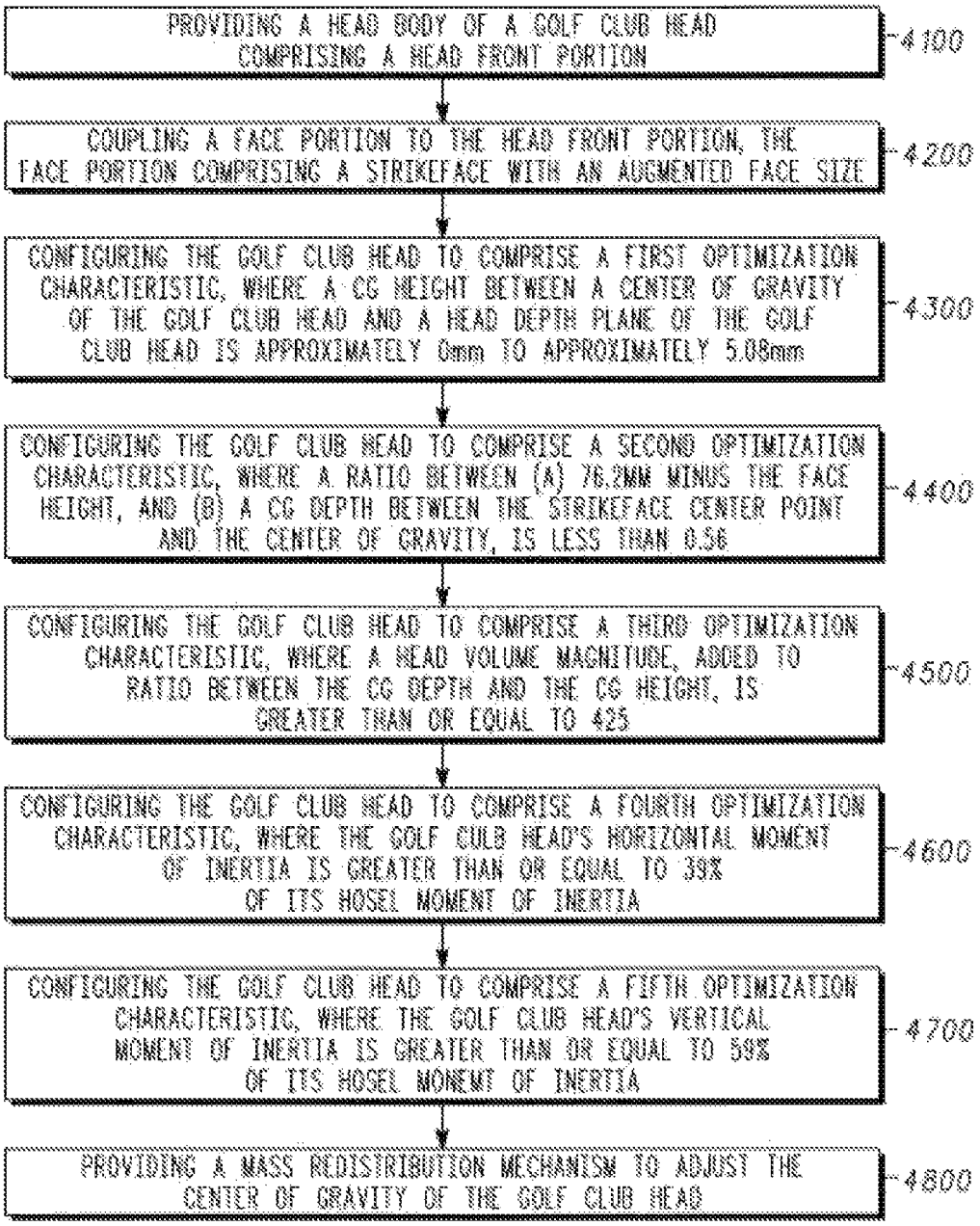
FIG. 4 illustrates a flowchart for a method that can be used to provide, form, and/or manufacture a golf club head in accordance with the present disclosure.

FIG. 4 illustrates a flowchart for method 4000, which can be used to provide, form, and/or manufacture a golf club head in accordance with the present disclosure. In some examples, the golf club head can be similar to golf club head 1000 (FIGS. 1-3) presented above.

Method 4000 comprises block 4100 for providing a head body of a golf club head comprising a head front portion. In some examples, the head body can be similar to head body 1100 (FIGS. 1-3), and the head front portion can be similar to head front portion 1110 (FIGS. 1-3).

Block 4200 of method 4000 comprises coupling a face portion to the head front portion, the head front portion comprising a strikeface with an augmented face size. In some examples, the face portion can be similar to face portion 1200 (FIGS. 1-2), with strikeface 1210 having the augmented face size described above with respect thereto. For example, the augmented face size of the strikeface may permit its face height to be of up to approximately 71 mm in some examples.

Method 4000 can comprise block 4300 for configuring the golf club head to comprise a first optimization characteristic, where a CG height between a center of gravity of the golf club head and a head depth plane of the golf club head can be approximately 0 mm to approximately 5.08 mm or 0.200 inches. In some examples, the first optimization characteristic can be similar to that described above with respect to Relation 1 for balancing golf club head face height or size with respect to center of gravity height. In some examples, the CG height may be similar to CG height 2520 (FIG. 2); the center of gravity may be similar to head center of gravity 2500 (FIG. 2); and the head depth plane can be similar to head depth plane 2310 (FIG. 2).

There can be implementations where method 4000 can comprise block 4400 for configuring the golf club head to comprise a second optimization characteristic, where a ratio between (a) 76.2 mm (or approximately 3.0 inches) minus the face height and (b) a CG depth between the strikeface centerpoint and the center of gravity, is less than 0.56. In some examples, the second optimization characteristic can be similar to that described above with respect to Relation 2 for balancing golf club head face height or size with respect to center of gravity depth. For example, the face height can be similar to face height 1213, and the CG depth can be similar to CG depth 2510.

In some examples, method 4000 can comprise block 4500 for configuring the golf club head to comprise a third optimization characteristic where a head volume magnitude, added to a ratio between the CG depth and the CG height, is greater than or equal to 425. In some implementations, the third optimization characteristic can be similar to that described above with respect to Relation 3 for balancing head volume relative to center of gravity location. For example, the head volume magnitude can be similar to the magnitude of head volume 2600 (FIG. 2), the CG depth can be similar to CG depth 2510, and the CG height can be similar to CG height 2520.

Method 4000 can comprise block 4600 in some embodiments for configuring the golf club head to comprise a fourth optimization characteristic, where the golf club head's horizontal moment of inertia is greater than or equal to 39% of its hosel moment of inertia. In some implementations, the fourth optimization characteristic can be similar to that described above with respect to Relation 4 for balancing horizontal MOI 1811 with respect to hosel MOI 1711 (FIG. 1). In the same or other examples, the magnitude of the horizontal moment of inertia can be similar to that described above with respect to horizontal MOI 1811. In addition, the magnitude of the hosel moment of inertia can be similar to that described above with respect to hosel MOI 1711. There can also be examples where the horizontal moment of inertia and/or the hosel moment of inertia can be balanced with respect to other features, such as with respect to a vertical moment of inertia of the golf club head.

Block 4700 of method 4000 can be carried out in some implementations for configuring the golf club head to comprise a fifth optimization characteristic, where the golf club head's vertical moment of inertia is greater than or equal to 59% of its hosel moment of inertia. In some implementations, the fifth optimization characteristic can be similar to that described above with respect to Relation 5 for balancing vertical MOI 1611 with respect to hosel MOI 1711 (FIG. 1). In the same or other examples, the magnitude of the vertical moment of inertia can be similar to that described above with respect to vertical MOI 1611. In addition, the magnitude of the hosel moment of inertia can be similar to that described above with respect to hosel MOI 1711. There can also be examples where the vertical moment of inertia and/or the hosel moment of inertia can be balanced with respect to other features, such as with respect to the horizontal moment of inertia of block 4500.

In the present example, method 4000 also comprises block 4800 for providing a mass redistribution mechanism to adjust the center of gravity of the golf club head. In some examples, the mass redistribution mechanism can be configured to permit the golf club head to achieve the requirements of block 4300, block 4400, block 4500, block 4600, and/or block 4700 of method 4000. The mass redistribution mechanism can comprise a weight structure, such as weight structure 2700 (FIGS. 2-3), which can adjust the location of the center of gravity towards the sole and/or the rear portion of the golf club head if desired. In the same or other embodiments, the mass redistribution mechanism can comprise a reduced thickness of the face portion of the golf club head, which may be reinforced if needed with one or more reinforcing structures, such as at the backside of the strikeface, and/or at a junction between the face portion and the head body of the golf club head.

In some examples, one or more of the different blocks of method 4000 can be combined into a single block or performed simultaneously, and/or the sequence of such blocks can be changed. For example, blocks 4100 and 4200 may be combined in some embodiments, such as where the face portion and at least one portion of the head body comprise a single piece of material. Block 4800 may be combined with one or more of blocks 4100, 4300, 4400, 4500, 4600, and/or 4700 in the same or other examples, and may be achieved simultaneously by adjusting the center of gravity, the face height, the face size, the head volume, and/or one or more moments of inertia of the golf club head, such as via the mass redistribution mechanism of block 4800. In the same or other examples, some of the blocks of method 4000 can be subdivided into several sub-blocks. For example, block 4100 can be subdivided into several sub-blocks for providing different portions of the head body of the golf club head. There can also be examples where method 4000 can comprise further or different blocks. As an example, method 4000 may comprise another block for providing or coupling a golf club shaft to the head body of block 4100. In addition, there may be examples where method 4100 can comprise only part of the blocks described above. For example, one or more of blocks 4300, 4400, 4500, 4600, and/or 4700 may be optional in some implementations, and/or block 4800 may be skipped if not needed to achieve the requirements of block 4300, block 4400, block 4500, block 4600, and/or block 4700. Other variations can be implemented for method 4000 without departing from the scope of the present disclosure.

Although the golf club heads with optimized characteristics and related methods herein have been described with reference to specific embodiments, various changes may be made without departing from the spirit or scope of the present disclosure. For instance, while the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Additional examples of such changes and others have been given in the foregoing description. Other permutations of the different embodiments having one or more of the features of the various figures are likewise contemplated. Accordingly, the specification, claims, and drawings herein are intended to be illustrative of the scope of the disclosure and is not intended to be limiting. It is intended that the scope of this application shall be limited only to the extent required by the appended claims.

The golf club heads with optimized characteristics and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:

a head body comprising a head interior bounded by a head front portion, a head rear portion, a head heel portion, a head toe portion, a head top portion, and a head sole portion;

a strikeface at the head front portion comprising a strikeface height and a geometric centerpoint, a face height being between 33 mm and 71 mm, and the geometric centerpoint positioned at a midpoint of the strikeface;

a head depth length measured from the geometric centerpoint of the strikeface to an intersection of an exterior of the head rear portion by a head depth plane;

a head center of gravity having a head CG depth and a head CG height;

wherein:

the club head comprises a driver-type body;

the head CG height is approximately 0 mm to approximately 5.08 mm;

the head CG depth is approximately 70 mm to approximately 102 mm;

a head volume of the golf club head is greater than approximately 450cc;

a head weight of the golf club head is approximately 185 grams to approximately 225 grams;

more than 20% of a mass of the club head is located in the rearmost 20% of a length of the club head;

more than 10% of the mass of the club head is located in the rearmost 10% of the length of the club head;

a fixed weight positioned on the head sole portion, wherein the fixed weight is located:

within 1 inch from a perimeter of the head rear portion;

a distance from a front plane of the club head greater than 4.0 inches; and a distance from the head center of gravity greater than 1.5 inches.

2. The golf club head of claim 1, wherein the head body further comprises a removable weight located towards the head sole portion and the head rear portion of the head body.

3. The golf club head of claim 2, wherein the removable weight further comprises:

a mass between 25 grams to 50 grams;

a volume between 20 cc to 30 cc;

a weight center of gravity located between a 5 o'clock ray and an 8 o'clock ray of a clock grid, the clock grid comprising:

a 12 o'clock ray;

a 3 o'clock ray;

a 4 o'clock ray;

a 5 o'clock ray;

a 8 o'clock ray; and a 9 o'clock ray;

when the golf club head is at an address portion, from a bottom view of the golf club head, the 12 o'clock ray is aligned with the geometric centerpoint and orthogonal to a front intersection line between a loft plane and a ground plane;

the clock grid is centered along the 12 o'clock ray, at a midpoint between a front end of the head front portion and a rear end of the head rear portion;

the 3 o'clock ray extends towards the head heel portion; and the 9 o'clock ray extends towards the head toe portion.

4. The golf club head of claim 3, wherein the removable weight protrudes at least partially from an external contour of the head sole portion.

5. The golf club head of claim 1, wherein more than 30% of the mass of the club head is located in the rearmost 20% of the length of the club head.

6. The golf club head of claim 1, wherein more than 15% of the mass of the club head is located in the rearmost 10% of the length of the club head.

7. The golf club head of claim 1, wherein the head CG depth comprises between 50% to 80% of the head depth length.

8. The golf club head of claim 1, further comprising one or more thin regions positioned on the head top portion, the one or more thin regions comprising a thickness less than 0.020 inch.

9. The golf club head of claim 1, wherein the fixed weight has a specific gravity greater than 10.0.

10. The golf club head of claim 1, wherein the fixed weight is positioned more than 2.5 inches from the head center of gravity.

11. The golf club head of claim 1, further comprising a crown angle, wherein the crown angle is less than 70 degrees when the crown angle is measured in a side cross sectional view of the club head taken through the geometric centerpoint of the strikeface, and the crown angle is less than 79 degrees when the crown angle is measured in a side cross sectional view of the club head taken through a point located approximately 1.0 inch toward the head toe portion from the geometric centerpoint of the strikeface.

12. A golf club head comprising:

a head body comprising a head interior bounded by a head front portion, a head rear portion, a head heel portion, a head toe portion, a head top portion, and a head sole portion;

a strikeface at the head front portion comprising a strikeface height and a geometric centerpoint, a face height being between 33 mm and 71 mm and the geometric centerpoint positioned at a midpoint of the strikeface;

a head center of gravity having a head CG depth and a head CG height;

wherein:

the club head comprises a driver-type body;

the head CG height is approximately 0 mm to approximately 12.8 mm;

the head CG depth is approximately 80 mm to approximately 102 mm;

a head volume of the golf club head is greater than approximately 450 cc;

a head weight of the golf club head is approximately 190 grams to approximately 240 grams;

more than 25% of a mass of the club head is located in the rearmost 20% of a length of the club head; and more than 15% of the mass of the club head is located in the rearmost 10% of the length of the club head;

at least one fixed weight comprising a mass greater than 12 grams.

13. The golf club head of claim 12, wherein the at least one fixed weight is located:

within 0.5 inch from a perimeter of the head rear portion;

a distance from a front plane of the club head greater than 4.5 inches;

a distance from the head center of gravity greater than 2.0 inches.

14. The golf club head of claim 12, wherein the at least one fixed weight is formed from a material selected from the group consisting of: tungsten, gold, hafnium, iridium, mercury, neptunium, osmium, palladium, platinum, plutonium, protactinium, rhenium, rhodium, ruthenium, tantalum, and uranium.

15. The golf club head of claim 12, wherein the at least one fixed weight is welded to the head body.

16. The golf club head of claim 12, further comprising:

a removable weight located towards the head sole portion and the head rear portion of the head body, the removable weight comprising:

a weight structure center of gravity located between a 5 o'clock ray and an 8 o'clock ray of a clock grid, the clock grid comprising:

a 12 o'clock ray;

a 3 o'clock ray;

a 4 o'clock ray;

a 5 o'clock ray;

a 8 o'clock ray; and a 9 o'clock ray;

when the golf club head is at an address portion, from a bottom view of the golf club head, the 12 o'clock ray is aligned with the geometric centerpoint and orthogonal to a front intersection line between a loft plane and a ground plane;

the clock grid is centered along the 12 o'clock ray, at a midpoint between a front end of the head front portion and a rear end of the head rear portion;

the 3 o'clock ray extends towards the head heel portion; and the 9 o'clock ray extends towards the head toe portion.

17. The golf club head of claim 16, wherein the removable weight protrudes at least partially from an external contour of the head sole portion.

18. The golf club head of claim 17, wherein the club head comprises the at least one fixed weight and the removable weight, wherein the at least one fixed weight is formed separately from the removable weight.

19. The golf club head of claim 16, wherein the removable weight further comprises:

a mass between 25 grams to 50 grams; and a volume between 20 cc to 30 cc.

20. The golf club head of claim 12, further comprising one or more thin regions positioned on the head top portion, the one or more thin regions comprising a thickness less than 0.020 inch.

* * * * *